US009688945B2

(12) United States Patent
Blattner et al.

(10) Patent No.: US 9,688,945 B2
(45) Date of Patent: Jun. 27, 2017

(54) COMPOSITIONS TO BOOST FABRIC SOFTENER PERFORMANCE

(71) Applicant: Ecolab USA Inc., St. Paul, MN (US)

(72) Inventors: Amanda Ruth Blattner, Prior Lake, MN (US); Charles Allen Hodge, Cottage Grove, MN (US); Claire Lucille Notermann, Eagan, MN (US); Julio R. Panama, Blaine, MN (US); Shaun Patrick Kennedy, North Oaks, MN (US)

(73) Assignee: Ecolab USA Inc., St. Paul, MN (US)

( * ) Notice: Subject to any disclaimer, the term of this patent is extended or adjusted under 35 U.S.C. 154(b) by 62 days.

(21) Appl. No.: 14/550,481

(22) Filed: Nov. 21, 2014

(65) Prior Publication Data

US 2016/0145539 A1 May 26, 2016

(51) Int. Cl.

| | |
|---|---|
| ***C11D 1/835*** | (2006.01) |
| ***C11D 3/00*** | (2006.01) |
| ***C11D 1/62*** | (2006.01) |
| ***C11D 1/66*** | (2006.01) |
| ***C11D 3/37*** | (2006.01) |

(52) U.S. Cl.

CPC ..... *C11D 3/001* (2013.01); *C11D 1/62* (2013.01); *C11D 1/667* (2013.01); *C11D 3/3742* (2013.01)

(58) Field of Classification Search

CPC ..... C11D 1/62; C11D 1/667; C11D 1/835; C11D 3/001

See application file for complete search history.

(56) References Cited

U.S. PATENT DOCUMENTS

| | | | |
|---|---|---|---|
| 3,033,699 | A | 5/1962 | Aarons et al. |
| 3,256,180 | A | 6/1966 | Weiss |
| 3,257,739 | A | 6/1966 | Wentz |
| 3,351,483 | A | 11/1967 | Miner, Jr. et al. |
| 3,529,923 | A | 9/1970 | Perry |
| 3,748,093 | A | 7/1973 | Gangwisch et al. |
| 3,862,058 | A | 1/1975 | Nirschl et al. |
| 3,886,075 | A | 5/1975 | Bernardino |
| 3,936,537 | A | 2/1976 | Baskerville, Jr. et al. |
| 4,218,359 | A | 8/1980 | Marwitz et al. |
| 4,255,484 | A | 3/1981 | Stevens |

(Continued)

FOREIGN PATENT DOCUMENTS

| | | |
|---|---|---|
| DE | 102004034266 | 2/2006 |
| EP | 0146289 | 6/1985 |

(Continued)

OTHER PUBLICATIONS

International Search Report and Written Opinion, issued in connection to International Application No. PCT/US2015/054169, 16 pages, issued on Dec. 22, 2015.

*Primary Examiner* — John Hardee

(74) *Attorney, Agent, or Firm* — McKee, Voorhees & Sease, PLC

(57) ABSTRACT

Method for treating a textile under industrial and institutional fabric care conditions to impart softness within a single wash and/or rinse cycle are disclosed. More particularly, the present invention relates to a combination of a liquid or solid fabric conditioning composition and a softening booster for treating a textile to impart softness within a single wash and/or rinse cycle. Compositions employed therein are further disclosed.

18 Claims, 27 Drawing Sheets

(56) References Cited

U.S. PATENT DOCUMENTS

| | | | |
|---|---|---|---|
| 4,292,035 | A | 9/1981 | Battrell |
| 4,292,362 | A | 9/1981 | Marwitz et al. |
| 4,419,250 | A | 12/1983 | Allen et al. |
| 4,427,558 | A | 1/1984 | David |
| 4,446,033 | A | 5/1984 | Barrat et al. |
| 4,472,287 | A | 9/1984 | Ramachandran et al. |
| 4,488,972 | A | 12/1984 | Weinstein |
| 4,624,713 | A | 11/1986 | Morganson et al. |
| 4,632,768 | A | 12/1986 | Atkinson |
| 4,659,496 | A | 4/1987 | Klemm et al. |
| 4,661,267 | A | 4/1987 | Dekker et al. |
| 4,661,269 | A | 4/1987 | Trinh et al. |
| 4,724,089 | A | 2/1988 | Konig et al. |
| 4,800,026 | A | 1/1989 | Coffindaffer et al. |
| 4,806,255 | A | 2/1989 | Konig et al. |
| 4,818,242 | A | 4/1989 | Burmeister et al. |
| 4,844,821 | A | 7/1989 | Mermelstein et al. |
| RE33,646 | E | 7/1991 | Klemm et al. |
| 5,039,769 | A | 8/1991 | Molock et al. |
| 5,064,544 | A | 11/1991 | Lin et al. |
| 5,070,073 | A | 12/1991 | Narula et al. |
| 5,116,520 | A | 5/1992 | Lichtenwalter et al. |
| 5,221,794 | A | 6/1993 | Ackerman et al. |
| 5,223,628 | A | 6/1993 | Whittlinger |
| 5,234,611 | A | 8/1993 | Trinh et al. |
| 5,403,499 | A | 4/1995 | Kiefer et al. |
| 5,405,542 | A | 4/1995 | Trinh et al. |
| 5,474,798 | A | 12/1995 | Larson et al. |
| 5,476,599 | A | 12/1995 | Rusche et al. |
| 5,500,138 | A | 3/1996 | Bacon et al. |
| 5,503,756 | A | 4/1996 | Corona, III et al. |
| 5,536,421 | A | 7/1996 | Hartman et al. |
| 5,562,847 | A | 10/1996 | Waite et al. |
| 5,593,611 | A | 1/1997 | Czech |
| 5,643,865 | A | 7/1997 | Mermelstein et al. |
| 5,674,831 | A | 10/1997 | Schulz et al. |
| 5,759,990 | A | 6/1998 | Wahl et al. |
| 5,773,409 | A | 6/1998 | Haq et al. |
| 5,777,046 | A | 7/1998 | Boeckh et al. |
| 5,783,534 | A | 7/1998 | Wahle et al. |
| 5,804,547 | A | 9/1998 | Godfroid et al. |
| 5,830,845 | A | 11/1998 | Trinh et al. |
| 5,977,055 | A | 11/1999 | Trinh et al. |
| 6,037,315 | A | 3/2000 | Franklin et al. |
| 6,083,899 | A | 7/2000 | Baker et al. |
| 6,093,336 | A | 7/2000 | Ploumen et al. |
| 6,110,886 | A | 8/2000 | Scepanski |
| 6,211,140 | B1 | 4/2001 | Sivik et al. |
| 6,271,193 | B1 | 8/2001 | Sprecker et al. |
| 6,306,814 | B1 | 10/2001 | Appel et al. |
| 6,448,212 | B1 | 9/2002 | Holderbaum et al. |
| 6,531,444 | B1 | 3/2003 | Shefer et al. |
| 6,547,981 | B2 | 4/2003 | Messner et al. |
| 6,576,606 | B2 | 6/2003 | Richards, III et al. |
| 6,737,390 | B2 | 5/2004 | Sunder et al. |
| 6,737,392 | B1 | 5/2004 | Keys et al. |
| 6,825,163 | B1 | 11/2004 | Kvita et al. |
| 6,881,717 | B1 | 4/2005 | Hall et al. |
| 6,884,766 | B2 | 4/2005 | DeClercq et al. |
| 6,884,767 | B1 | 4/2005 | Frankenbach et al. |
| 6,903,061 | B2 | 6/2005 | Masschelein et al. |
| 6,914,042 | B2 | 7/2005 | Gregory et al. |
| 7,049,276 | B2 | 5/2006 | Altmann et al. |
| 7,056,879 | B2 | 6/2006 | Wang et al. |
| 7,108,725 | B2 | 9/2006 | Caswell et al. |
| 7,144,431 | B2 | 12/2006 | Gardner et al. |
| 7,205,270 | B2 | 4/2007 | Delplancke et al. |
| 7,749,952 | B2 | 7/2010 | Zhang et al. |
| 8,038,729 | B2 | 10/2011 | Hodge et al. |
| 2001/0021692 | A1 | 9/2001 | Mohammadi et al. |
| 2002/0037825 | A1 | 3/2002 | Demeyere et al. |
| 2002/0128170 | A1 | 9/2002 | DeClercq et al. |
| 2002/0193272 | A1 | 12/2002 | Clarkson et al. |
| 2003/0013632 | A1 | 1/2003 | Santos et al. |
| 2003/0068295 | A1 | 4/2003 | Rohde et al. |
| 2003/0199420 | A1 | 10/2003 | Tsumori et al. |
| 2003/0224965 | A1 | 12/2003 | Conley et al. |
| 2003/0236181 | A1 | 12/2003 | Chan et al. |
| 2004/0023838 | A1 | 2/2004 | Schramm, Jr. et al. |
| 2004/0053798 | A1 | 3/2004 | Kasturi et al. |
| 2004/0067866 | A1 | 4/2004 | Griese et al. |
| 2004/0101505 | A1 | 5/2004 | Payne et al. |
| 2004/0139990 | A1 | 7/2004 | Wachter et al. |
| 2004/0167056 | A1 | 8/2004 | Lentsch et al. |
| 2004/0204337 | A1 | 10/2004 | Corona, III et al. |
| 2004/0253376 | A1 | 12/2004 | Parker |
| 2005/0009720 | A1 | 1/2005 | Delplancke et al. |
| 2005/0164900 | A1 | 7/2005 | Masschelein et al. |
| 2005/0170994 | A1 | 8/2005 | Casado-Dominguez et al. |
| 2005/0197269 | A1 | 9/2005 | Graydon et al. |
| 2005/0197279 | A1 | 9/2005 | Graydon et al. |
| 2005/0227907 | A1 | 10/2005 | Lee et al. |
| 2006/0030513 | A1 | 2/2006 | Binder et al. |
| 2006/0037150 | A1 | 2/2006 | Offord et al. |
| 2006/0063690 | A1 | 3/2006 | Billiauw et al. |
| 2006/0089294 | A1 | 4/2006 | Depoot et al. |
| 2006/0264352 | A1 | 11/2006 | Sajic et al. |
| 2006/0293213 | A1 | 12/2006 | Uehara et al. |
| 2007/0050915 | A1 | 3/2007 | Frankenbach |
| 2008/0253981 | A1 | 10/2008 | Lupia et al. |
| 2009/0144913 | A1 | 6/2009 | Yu et al. |
| 2011/0177994 | A1 | 7/2011 | Wahl et al. |
| 2011/0239379 | A1 | 10/2011 | Hodge et al. |
| 2011/0281782 | A1* | 11/2011 | Panandiker ..... C11D 3/001 510/329 |
| 2012/0030882 | A1 | 2/2012 | Wetrosky et al. |
| 2013/0065813 | A1* | 3/2013 | Miravet Celades . C11D 7/3263 510/516 |

FOREIGN PATENT DOCUMENTS

| | | |
|---|---|---|
| EP | 0150531 | 8/1985 |
| EP | 0164797 | 12/1985 |
| EP | 0234082 A1 | 9/1987 |
| EP | 0234082 B1 | 9/1987 |
| EP | 0258500 A1 | 3/1988 |
| EP | 0328182 | 8/1989 |
| EP | 0535942 B1 | 4/1993 |
| EP | 0535942 B2 | 4/1993 |
| EP | 0580245 A2 | 1/1994 |
| EP | 0580245 A3 | 1/1994 |
| EP | 0885283 | 12/1998 |
| EP | 0912673 | 5/1999 |
| EP | 0920486 | 6/1999 |
| EP | 1075503 | 2/2001 |
| EP | 1075864 | 2/2001 |
| EP | 1095128 | 5/2001 |
| EP | 1167456 | 1/2002 |
| EP | 1558718 | 8/2005 |
| EP | 1561804 | 8/2005 |
| EP | 1561806 | 8/2005 |
| EP | 1883692 | 2/2008 |
| GB | 1044546 | 10/1966 |
| KR | 19910000055 | 11/1984 |
| WO | 9533038 | 12/1995 |
| WO | 9816538 | 4/1998 |
| WO | 9817756 | 4/1998 |
| WO | 9845394 | 10/1998 |
| WO | 9847991 | 10/1998 |
| WO | 9906509 | 2/1999 |
| WO | 0114313 | 3/2001 |
| WO | 0125384 | 4/2001 |
| WO | 02081611 | 10/2002 |
| WO | 2004000016 | 12/2003 |
| WO | 2005075618 | 8/2005 |
| WO | 2005075620 | 8/2005 |
| WO | 2005105969 | 11/2005 |
| WO | 2005105970 | 11/2005 |
| WO | 2006132979 | 12/2006 |
| WO | 2007096790 | 8/2007 |
| WO | 2011011247 | 1/2011 |

* cited by examiner

COMPOSITIONS TO BOOST FABRIC SOFTENER PERFORMANCE

FIELD OF THE INVENTION

The present invention relates to methods for treating a textile under industrial and institutional fabric care conditions to impart softness within a single wash cycle and/or rinse cycle. Compositions for boosting a liquid or solid softening or conditioning compositions are also provided. More particularly, the present invention relates to methods for softening a textile within a wash cycle and/or rinse cycle employing a softening booster.

BACKGROUND OF THE INVENTION

Use of fabric softening compositions in the consumer and residential sector is commonplace. Fabric softening compositions are known to comprise major amounts of water, lesser amounts of fabric softening agents, such as quaternary ammonium compounds, and minor amounts of optional ingredients such as perfumes, colorants, preservatives and stabilizers. Such compositions are aqueous suspensions or emulsions that are conveniently added to the rinsing bath of residential washing machines to improve the softness of the laundered fabrics.

The use of fabric softening compositions in the harsher conditions associated with industrial and institutional settings presents additional challenges as compared to the consumer or residential sector. In the industrial and institutional sector, soil levels found in the linens are much higher than in the residential or consumer sector. Wash cycles in the residential sector have a near neutral pH whereas the wash cycles in the industrial and institutional sector have a pH of greater than about 9. Dryers are operated at substantially higher temperatures (e.g. between about 180° F. and about 270° F.) than those found in the consumer or residential market (e.g. maximum fabric temperatures of about 120° F. and about 160° F.). These harsher conditions for industrial and institutional settings often result in negative effects on the fabric, e.g. undue premature yellowing or dulling of the fabrics. This is particularly problematic as a majority of linens in the institutional and industrial sector are white. Therefore, providing softening in both industrial and institutional settings requires improvements within the art. It is easily appreciated that it is desirable to provide a fabric conditioning agent that does not cause significant yellowing or dulling of fabrics that are repeatedly washed and dried. Moreover, it is generally desirable for white laundry that is dried to remain white even after multiple drying cycles. That is, it is desirable that the fabric not yellow or dull after repeated cycles of drying.

Softening traits are a highly desired combination of properties for textiles such as fibers and fabrics, both woven and non-woven. By the term "softness" it is meant the quality perceived by users through their tactile sense to be soft. Such tactile perceivable softness may be characterized by, but not limited to resilience, flexibility, fluffiness, slipperiness, and smoothness and subjective descriptions such as "feeling like silk or flannel." By the term, "industrial and institutional" it is meant that the operations are located in the service industry including but not limited to hotels, motels, hospitals, nursing homes, restaurants, health clubs, large scale industrial applications and the like.

It is an object of the invention to provide improved methods of softening textiles using a boosted fabric softening system.

It is a further object of the invention to provide methods of softening textiles using a boosted fabric softening system within a single wash cycle and/or rinse cycle of industrial and institutional laundering. In a preferred aspect, the methods of softening textiles use a boosted fabric softening system within a single rinse cycle.

Other objects, advantages and features of the present invention will become apparent from the following specification taken in conjunction with the accompanying drawings.

BRIEF SUMMARY OF THE INVENTION

An advantage of the invention is that combined compositions for conditioning fabrics and methods thereof are suitable for boosting fabric conditioning or softness during the rinse cycle of industrial or institutional laundering operations. The boosted compositions, and methods of use thereof, according to the invention provide improved softness within a single wash cycle and/or rinse cycle, beneficially imparting to laundered fabrics a texture or hand that is smooth pliable and fluffy to the touch (i.e. soft). The softening boosting according to the invention can be used during a rinse cycle following a wash cycle or used with a rinse cycle alone (i.e. boosting softness of clean, previously laundered fabrics). Beneficially, the methods according to the invention provide softness to treated fabrics at least equivalent to consumer home use or residential softeners. The methods according to the invention may provide additional benefits to treated fabrics, including for example, static control, reduced discoloring (i.e. yellowing), and/or dulling and/or fading especially when the fabrics are washed in a high alkaline detergent and/or dried in an automatic dryer at industrial and institutional conditions.

In an embodiment, the present invention provides methods of softening fabrics during the rinse cycle of industrial or institutional laundering operations. The softening booster compositions of the invention are used in combination with a fabric conditioning composition to impart to laundered fabrics a texture or hand that is smooth pliable and fluffy to the touch (i.e. soft), especially when the fabrics are washed in a high alkaline detergent and/or dried in an automatic dryer at industrial and institutional conditions. Beneficially the methods of softening provide an improved softness over conventional fabric conditioning/softening compositions alone during a single rinse cycle of the laundering operation.

In another embodiment, the present invention provides systems for softening, including a combination of a fabric conditioning composition comprising one or more softening agents selected from quaternary ammonium components and amino-functionalized silicone compounds, and a softening booster composition comprising a clay-based booster, a quaternary ammonium booster or a sucrose ester booster for use in an industrial and institutional fabric care operation. Beneficially, the systems of the present invention imparts softness superior to commercial or residential softeners.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
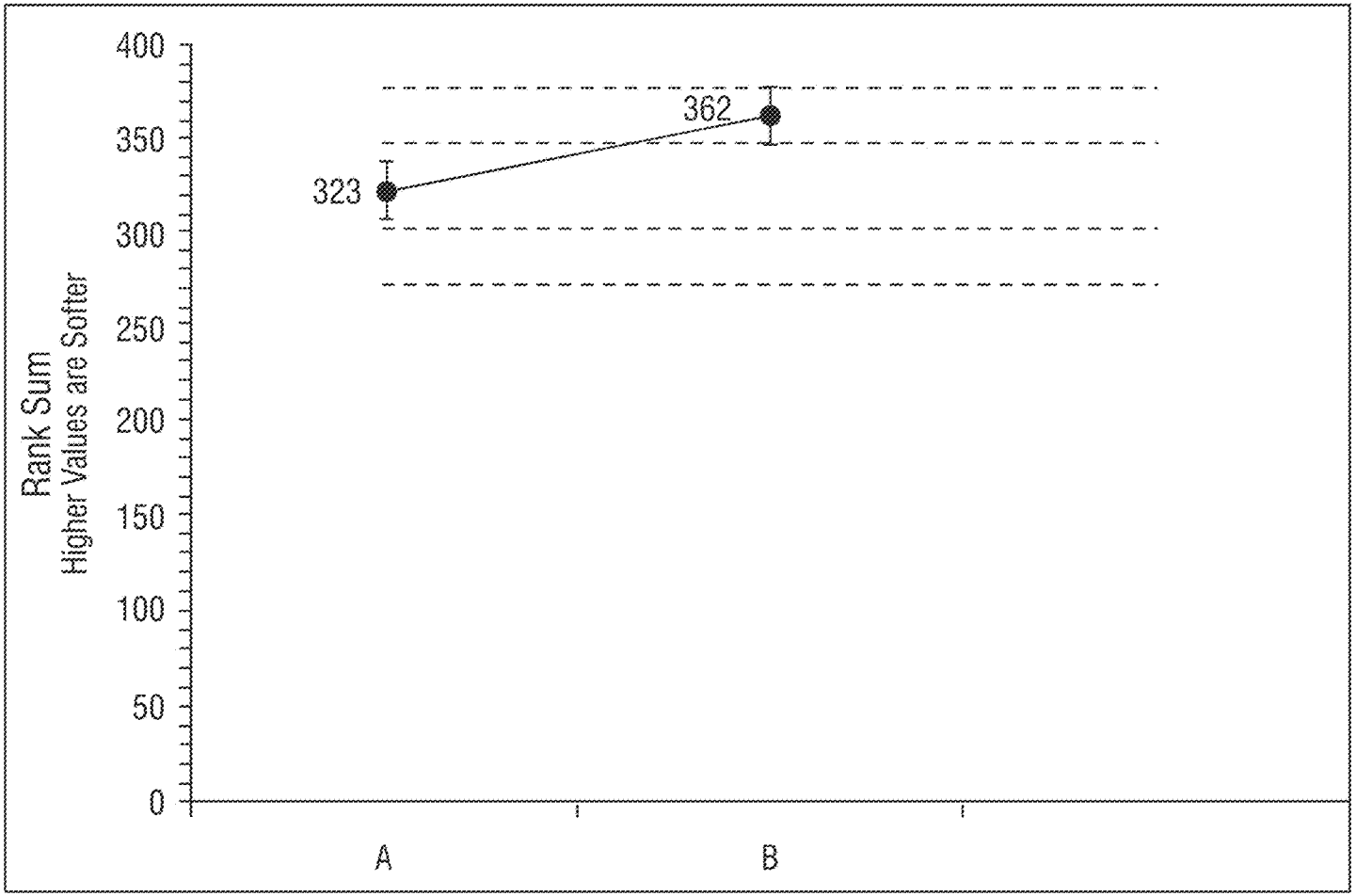
FIGS. 1-21 depict graphs showing rank sum ratings for softening boosters evaluated in Example 1 according to embodiments of the invention (high values correlate to softer panel evaluation results).

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The present invention relates to methods for conditioning fabrics and boosting fabric softness during the rinse cycle of industrial or institutional laundering operations, providing numerous advantages over conventional industrial or institutional laundering operations. For example, softness is imparted within a single wash cycle and is suitable for withstanding the harsh conditions of industrial or institutional laundering operations. The embodiments of this invention are not limited to particular preferred methods and/or boosted fabric conditioning compositions, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range (e.g. 1 to 5 includes 1, 1.5, 2, 2.75, 3, 3.80, 4, and 5).

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning or fabric softening expressed as a percentage minus inert ingredients such as water or salts. As one skilled in the art will recognize, many laundering components are sold as emulsions and the percentage of active ingredients is included by the manufacture. As a matter of example only, if 100% of a final composition is comprised of emulsion X and if emulsion X contains 60% of the active component X, we would say that the final composition contained 60% active component X.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardency. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Embodiments

Exemplary dosing the softening booster compositions for use in a single rinse cycle is set forth below according to the invention in Table 1 in an actives weight percentage of softening booster in use solution indexed to the actives weight percentage of the fabric softening composition. The softening booster compositions are dosed at the actives weight percentage shown in Table 1 on top of the softening actives employed in the fabric conditioning compositions.

TABLE 1

| Material | First Exemplary Actives % Range in Useto Fabric Softening Composition Dose | Second Exemplary Actives % Range in Use to Fabric Softening Composition Dose | Third Exemplary Actives % Range in Use to Fabric Softening Composition Dose | Fourth Exemplary Actives % Range in Use to Fabric Softening Composition Dose |
|---|---|---|---|---|
| Softening Booster Composition | 0.1-40 | 1-35 | 5-30 | 10-25 |

In some aspects the ratio of the softening booster composition employed to the fabric conditioning composition is in an actives ratio of from about 1:1 to about 4:1, from about 1:1 to about 3:1, or from about 1:1 to about 2:1. In yet a further aspect the ratio of softening booster composition employed to the fabric conditioning composition is in an actives ratio of from about 1:1 to about 1:4, from about 1:1 to about 1:3, or from about 1:1 to about 1:2. In other aspects, the actives ratio of the softening booster composition to fabric conditioning composition about 1:1 to about 2:1. Without being limited according to the invention, all ranges for the ratios recited are inclusive of the numbers defining the range.

Beneficially, the use of the softening booster compositions according to the invention provide a soft, non-yellowing, non-greasy feel to treated fabrics and textiles. Beneficially, such results are achieved in a single rinse cycle.

The softening booster compositions may include concentrate compositions or may be diluted to form use compositions. In general, a concentrate refers to a composition that is intended to be diluted with water to provide a use solution that contacts an object to provide the desired softening boost. The softening booster compositions that contacts the articles to be washed can be referred to as a concentrate or a use composition (or use solution) dependent upon the formulation employed in methods according to the invention.

A use solution may be prepared from a concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 10,000.

Sucrose Ester Softening Booster Compositions

In an aspect, the softening booster is a sucrose fatty acid ester. The sucrose fatty acid esters are preferably non-ionic emulsifiers based on sucrose and a combination of stearate, palmitate, laurate, distearate, and/or tetrastearate triacetate. In an aspect, the sucrose fatty acid ester is both non-ionic and non-PEG.

Preferred sucrose fatty acid esters include sucrose laurate, sucrose palmitate, sucrose stearate, sucrose distearate, sucrose polystearate, sucrose tetrastearate triacetate, polyglycerol monostearate, sorbitan monostearate, sorbitan palmitate, polyglycerol and the like.

The sucrose fatty acid ester softening booster is particularly suitable for boosting softening when used in combination with the fabric conditioning compositions disclosed herein. In some aspects, the sucrose fatty acid ester softening booster unexpectedly provides improved softening when used in sequence after the quaternary ammonium fabric softening composition. As set forth with respect to methods of softening fabric, the step of contacting the fabric with a fatty acid ester softness boosting compositions is a second dosing for softness after contacting the fabric with the fabric conditioning composition. The subsequent dosing may take place a few seconds to a few minutes after the fabric conditioning composition, such as from about 1 minute to about 5 minutes, or preferably from about 2 minutes to about 3 minutes.

In a preferred aspect, the softening booster is a sucrose ester sold under the tradename Sisterna® available from Sisterna BV, including the following: L70-C (aqua, sucrose laurate, alcohol); PS750-C (sucrose palmitate); SP70-C (sucrose stearate); SP50-C (sucrose palmitate); SP30-C (sucrose distearate); SP10-C (sucrose polystearate); SP01-C (sucrose polystearate); and A10E-C (sucrose tetrastearate triacetate).

Sucrose fatty acid ester softening booster compositions are preferably added to a wash cycle, more preferably a single wash cycle with the fabric softening compositions disclosed herein, at an actives concentration level of at least about 1% to about 20% to fabric softening composition dose. In a preferred aspect, the clay softening booster compositions are provided at an actives level of about 5% to about 20%, or about 5% to about 10% to fabric softening composition dose.

Fabric Conditioning Compositions

In an aspect of the invention a fabric conditioning composition may comprise at least the following components: a quaternary ammonium compound and a silicone component, preferably an amino-functionalized silicone compound. Fabric conditioning compositions may further comprise, consist of and/or consist essentially of a quaternary ammonium compound, the silicone component, surfactants, carriers, solidification agents (e.g. urea, such as disclosed in U.S. Patent Publication No. 2012/0030882 for solid fabric conditioner compositions) and various additional functional ingredients.

For the purposes of this disclosure, the term "fabric softener" or "fabric conditioner" shall be understood to mean an industrial product added to the wash or rinse cycle of a laundry process for the express or primary purpose of conferring one or more conditioning benefits. Fabric conditioning compositions employed according to the invention may be provided in liquid and/or solid formulations.

For solid formulations, fabric conditioning compositions can take the form of a dilutable fabric conditioner, that may be a molded solid, a tablet, a powder, a block, a bar, or any other solid fabric conditioner form known to those skilled in the art. A "dilutable fabric conditioning" composition is defined, for the purposes of this disclosure, as a product intended to be used by being diluted with water or a non-aqueous solvent by a ratio of more than 100:1, to form a treatment suitable for treating textiles and conferring to them one or more conditioning benefits. Particularly preferred forms include conditioner products, especially as a solid, intended for application as a fabric softener during the wash cycle or the final rinse.

For either solid or liquid formulations, the fabric conditioning compositions can also take the form of a fabric softener intended to be applied to articles without substantial dilution and sold as any form known to those skilled in the art as a potential medium for delivering such fabric softeners to the industrial and institutional market. For example, powders for direct application to fabrics are also considered within the scope of this disclosure. Such examples, however, are provided for illustrative purposes and are not intended to limit the scope of this invention.

The preferred pH range of the composition for shelf stability is between about 2 and about 8. The pH is dependent upon the specific components of the composition of the invention.

Quaternary Ammonium Components

A softening agent of the fabric conditioning composition is a quaternary ammonium compound. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

Exemplary alkylated quaternary ammonium compounds include ammonium compounds having an alkyl group containing between 6 and 24 carbon atoms. Exemplary alkylated quaternary ammonium compounds include monoalkyl trimethyl quaternary ammonium compounds, monomethyl trialkyl quaternary ammonium compounds, and dialkyl dimethyl quaternary ammonium compounds. The alkyl group can be a C8-C22 group or a C8-C18 group or a C12-C22 group that is aliphatic and saturated or unsaturated or straight or branched, an alkyl group, a benzyl group, an alkyl ether propyl group, hydrogenated-tallow group, coco group, stearyl group, palmityl group, and soya group. Exemplary ring or cyclic quaternary ammonium compounds include imidazolinium quaternary ammonium compounds.

Exemplary imidazolinium quaternary ammonium compounds include methyl-1hydr. tallow amido ethyl-2-hydr. tallow imidazolinium-methyl sulfate, methyl-1-tallow amido ethyl-2-tallow imidazolinium-methyl sulfate, methyl-1-oleyl amido ethyl-2-oleyl imidazolinium-methyl sulfate, and 1-ethylene bis(2-tallow, 1-methyl, imidazolinium-methyl sulfate).

Exemplary aromatic quaternary ammonium compounds include those compounds that have at least one benzene ring in the structure. Exemplary aromatic quaternary ammonium compounds include dimethyl alkyl benzyl quaternary ammonium compounds, monomethyl dialkyl benzyl quaternary ammonium compounds, trimethyl benzyl quaternary ammonium compounds, and trialkyl benzyl quaternary ammonium compounds. The alkyl group can contain between about 6 and about 24 carbon atoms, and can contain between about 10 and about 18 carbon atoms, and can be a stearyl group or a hydrogenated tallow group. The aromatic quaternary ammonium compounds can include multiple benzyl groups. Diquaternary ammonium compounds include those compounds that have at least two quaternary ammonium groups. An exemplary diquaternary ammonium compound is N-tallow pentamethyl propane diammonium dichloride.

Exemplary alkoxylated quaternary ammonium compounds include methyldialkoxy alkyl quaternary ammonium compounds, trialkoxy alkyl quaternary ammonium compounds, trialkoxy methyl quaternary ammonium compounds, dimethyl alkoxy alkyl quaternary ammonium compounds, and trimethyl alkoxy quaternary ammonium compounds. The alkyl group can contain between about 6 and about 24 carbon atoms and the alkoxy groups can contain between about 1 and about 50 alkoxy groups units wherein each alkoxy unit contains between about 2 and about 3 carbon atoms.

Exemplary amidoamine quaternary ammonium compounds include diamidoamine quaternary ammonium compounds. Exemplary amidoamine quaternary ammonium compounds that can be used according to the invention are methyl-bis(tallow amidoethyl)-2-hydroxyethyl ammonium methyl sulfate, methyl bis(oleylamidoethyl)-2-hydroxyethyl ammonium methyl sulfate, and methyl bis (hydr.tallowamidoethyl)-2-hydroxyethyl ammonium methyl sulfate.

Exemplary ester quaternary ammonium compounds include, for example, those commercially-available from Stepan and Evonik under the tradenames Stepantex® VL 90, Stepantex® SP 90, Stepantex® VT 90, Rewopol® WE-16 and Rewopol® WE-18.

The quaternary ammonium compounds can include any counter ion that allows the component to be used in a manner that imparts fabric-softening properties according to the invention. Exemplary counter ions include chloride, methyl sulfate, ethyl sulfate, and sulfate.

In certain fabric softening composition the amount of active quaternary ammonium component can range from about 2% to about 55%, from about 5% to about 50%, in preferred aspects from about 30% to about 55%, or from about 30% to about 45%, by weight of the total fabric conditioning composition in a solid composition. In other preferred aspects from about 2% to about 35%, or from about 6% to about 25%, by weight of the total fabric conditioning composition in a liquid composition. In addition, without being limited according to the invention, all ranges recited are inclusive of the numbers defining the range.

If the quaternary ammonium component is an ester quaternary ammonium, the preferred pH is somewhat lower because the ester linkages may break with higher pHs. As such, it is preferred that compositions of the invention that include ester quaternary ammoniums have a pH in the range of between about 3 and about 6, more preferably in the range of between about 4 and about 5. Amidoamine quaternary ammoniums tolerate a somewhat higher pH and as such compositions of the invention that include amidoamine quaternary ammoniums will likely have a pH in the range of between about 3 and about 8. Because many quaternary ammonium components can decompose at high pH, especially when they contain amine moieties, it is desirable to keep the pH of the composition below the pKa of the amine group that is used to quaternize the selected quaternary ammonium component, below which the propensity for this to occur is greatly decreased. This reaction can cause the product to lose effectiveness over time and create an undesirable product odor. As such, a reasonable margin of safety, of 1-2 units of pH below the pKa should ideally be used in order to drive the equilibrium of this reaction to strongly favor quaternary ammonium component stability. Although the preferred pH of the product will depend on the particular quaternary ammonium component selected for formulation, typically these values should be below about 6 to about 8.5. The conditioning bath pH, especially in the case of powdered softener and combination detergent/softener products, can often be less important, as the kinetics of quaternary ammonium component decomposition are often slow, and the time of one conditioning cycle is typically not sufficient to allow for this reaction to have a significant impact on the performance or odor of the product. A lower pH can also aid in the formulation of higher-viscosity products.

Silicone Compound

An additional softening agent of the fabric conditioning composition is a silicone compound. The silicone compound of the invention can be a linear or branched structured silicone polymer. The silicone of the present invention can be a single polymer or a mixture of polymers.

The silicone component may include an amino functional silicone compounds. Amino functional silicones are also referred to herein as amino-functional silicone compounds. The amino-functional silicone of the invention can be a linear or branched structured amino-functional silicone polymer. The amino-functional silicone of the present invention can be a single polymer or a mixture of polymers, including a mixture of polymers wherein one of the polymers contains no amino functionality, e.g., a polydimethylsiloxane polymer.

In certain fabric softening compositions the amount of active silicone component can range from about 0.05% to about 40%, from about 5% to about 20%, or from about 5% to about 10%, by weight of the total fabric conditioning composition in either solid or liquid compositions. In addition, without being limited according to the invention, all ranges recited are inclusive of the numbers defining the range.

Surfactant Systems

The fabric softening composition can comprise at least one surfactant system. A variety of surfactants can be used in the composition of the invention, including preferably nonionic and quaternary surfactants, which are commercially available from a number of sources. For a discussion of surfactants, see Kirk-Othmer, Encyclopedia of Chemical Technology, Third Edition, volume 8, pages 900-912. Preferably, the fabric softening composition comprises a surfactant system in an amount between about 5-20 wt-%, preferably between about 5-10 wt-%.

Nonionic surfactants useful in the fabric conditioning compositions include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ehtoxylate, polyoxyethylene glycol ethers and the like; carboxylic acid esters such as clyerol esters, polyoxyethylene ester, ethoxylated and glycol ester of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC® (BASF), and the like; and other like nonionic compounds.

Also useful are quaternary surfactants which include, for example, lauryldimoniumhydroxypropyl decylglucosides chloride, lauryldimoniumhydroxypropyl laurylglucosides chloride, stearyldimoniumhydroxypropyl decylglucosides chloride, stearyldimoniumhydroxypropyl laurylglucosides chloride, cocoglucosides hydroxypropyltrimonium chloride, laurylglucosides hydroxypropyltrimonium chloride, laurylglucosides hydroxypropyltrimonium chloride, lauryldimoniumhydroxypropyl cocoglucosides chloride, stearyldimoniumhydroxypropyl laurylglucosides chloride, polyoxypropylene methyl diethylammonium chloride, and the like.

Carriers

The carrier component of the fabric conditioning compositions can be any components that help to contain the softening agents within the composition, and allows the softening agents to form a treatment suitable for treating textiles and conferring to them one or more conditioning benefits. The carrier component is mixed with the softening agents and can be melted, mixed, and allowed to solidify to form a desired shape. Exemplary techniques for forming the composition of the present invention include injection molding, casting, solution mixing, extrusion, and melt mixing. In general, it may be desirable for the carrier component and the softening agents to be soluble in each other, and sufficiently water soluble to allow water solubility induced movement of the composition during treatment. The carrier component can be selected to provide the fabric conditioning composition as a either a liquid or solid during treatment.

Exemplary polymers that can be used as the carrier component include polyalkylenes such as polyethylene, polypropylene, and random and/or block copolymers of polyethylene and polypropylene; polyesters such as polyethylene glycol and biodegradable polymers such as polylactide and polyglycolic acid; polyurethanes; polyamides; polycarbonates; polysulfonates; polysiloxanes; polydienes such as polybutylene, natural rubbers, and synthetic rubbers; polyacrylates such as polymethylmethacrylate; and additional polymers such as polystyrene and polyacrylonitrile-butadiene-styrene; mixtures of polymers; and copolymerized mixtures of polymers. Preferred carriers for solid formulations include polyethylene glycol with a molecular weight of 4000 (PEG-4000) to about 8000 (PEG-8000).

Some short chain alcohols are present in commercially available quaternary ammonium compound products. Such products can be used in the preparation of preferred aqueous compositions of the present invention. The short chain alcohols are normally present in such products at a level of from about 0.5% to about 10% by weight of the aqueous compositions.

In certain fabric softening compositions the amount of carrier in the composition includes up to about 95% by weight, more preferably up to about 80% by weight, and most preferably up to about 60% by weight. In other aspects, the amount of carrier in the composition can include about 5 wt % to about 50 wt % carrier, preferably about 5 wt % to about 20 wt % carrier, based on the total weight of the composition. In addition, without being limited according to the invention, all ranges recited are inclusive of the numbers defining the range.

Additional Functional Ingredients

In some embodiments, the softening booster compositions and/or fabric conditioning compositions including additional functional ingredients. In yet other embodiments few or no additional functional ingredients are disposed therein the softening booster compositions and/or fabric conditioning compositions. Instead, additional functional ingredients may be employed within the detergent compositions, bleaching compositions or the like employed within the laundering process.

Functional ingredients provide desired properties and functionalities to the various compositions employed according to the invention. The term "functional ingredient" includes a material that when dispersed or dissolved in a use and/or concentrate solution, such as an aqueous solution, provides a beneficial property in a particular use. A broad variety of functional ingredients may be used, including for example, fragrances (e.g. perfumes) and/or dyes, odor capturing agents, anti-static agents, fiber protection agents, anti-wrinkling agents, soil release agents, optical brighteners, UV protection agents, anti-pilling agents, water repellency agents, disinfecting and/or sanitizing agents, scouring agents, insect repellants, defoaming agents, anti-redeposition agents, bleaching agents, solubility modifiers, dispersants, rinse aids, stabilizing agents, freeze-thaw control agents, shrinkage control agents, additional sequestrants and/or chelating agents, surfactants, rheology modifiers or thickeners to provide viscosity control, hydrotropes or couplers, buffers, solvents, dye scavengers, molecular chelants, sequestering agents and the like.

The various additional functional ingredients, if used in either the softening booster compositions and/or fabric conditioning compositions, are added at their usual levels, generally each of up to about 10% or preferably up to about 5% by weight of the composition.

Additional disclosure of exemplary additional functional ingredients suitable for use in the compositions and/or methods of the present invention are set forth, for example, in U.S. Patent Publication No. 2011/0239379, 2012/0030882 and U.S. Pat. No. 8,038,729, which are herein incorporated by reference in their entirety.

Methods of Use

Applicants found that in the higher alkalinity and higher temperature conditions of the industrial and institutional sector that improved softening and fabric conditioning can be achieved in a single wash and/or rinse cycle through the combined use of fabric conditioning compositions (e.g. amino silicone and quaternary ammonium compounds) with softening booster compositions (e.g. clay-based, quaternary compound based and/or sucrose ester based boosters). Beneficially, the boosted compositions do not alter fabric conditioning properties, such as yellowing.

Fabrics that can be processed according to the methods of the invention include any textile or fabric material that can be processed in an industrial dryer for the removal of water. Fabrics are often referred to as laundry in the case of industrial laundry operations. While the invention is characterized in the context of softening "fabric," it should be understood that items or articles that include fabric could similarly be treated. In addition, it should be understood that items such as towels, sheets, and clothing are often referred to as laundry and are types of fabrics. Textiles that benefit by treatment of the method of the present invention are exemplified by (i) natural fibers such as cotton, flax, silk and wool; (ii) synthetic fibers such as polyester, polyamide, polyacrylonitrile, polyethylene, polypropylene and polyurethane; and (iii) inorganic fibers such as glass fiber and carbon fiber. Preferably, the textile treated by the method of the present invention is a fabric produced from any of the above-mentioned fibrous materials or blends thereof. Most preferably, the textile is a cotton-containing fabric such as cotton or a cotton-polyester blend. Additional laundry items that can be treated include athletic shoes, accessories, stuffed animals, brushes, mats, hats, gloves, outerwear, tarpaulins, tents, and curtains. However, due to the harsh conditions imparted by industrial dryers, the laundry items useful according to the present invention must be able to withstand the high temperature conditions found in an industrial dryer.

The dryers utilized according to the invention can be used include any type of dryer that uses heat and/or agitation and/or air flow to remove water from the laundry. An exemplary dryer includes a tumble-type dryer where the laundry is provided within a rotating drum that causes the laundry to tumble during the operation of the dryer. Tumble-type dryers are commonly found in industrial and institutional sector laundry operations.

The compositions and systems of the invention are particularly useful in harsher conditions found in industrial and institutional settings. By the term, "industrial and institutional" it is meant that the operations are located in the service industry including but not limited to hotels, motels, restaurants, health clubs, healthcare, and the like. Dryers in such operations operate at substantially higher temperatures than those found in the consumer or residential market. It is expected that industrial or commercial dryers operate at maximum fabric temperatures that are typically provided in the range of between about 180 degrees Fahrenheit and about 270 degrees Fahrenheit, and consumer or residential dryers often operate at maximum fabric temperatures of between about 120 degrees Fahrenheit and about 160 degrees Fahrenheit. Industrial and institutional dryers operate in the range of about 180 degrees Fahrenheit up to about 270 degrees Fahrenheit, more preferably, about 220 degrees up to about 260 degrees Fahrenheit, and most preferably about 240 degrees Fahrenheit up to about 260 degrees Fahrenheit. It is generally understood that drying temperatures may change with new drying technologies.

The softening booster compositions according to the invention are added at a point of use to boost or improve softening in comparison to laundering application employing a fabric conditioning composition alone. In an aspect, the softening booster compositions are added either before or after the fabric softening composition (i.e. separate dosing into a machine).

Exemplary methods of use may include the following general steps: (a) washing the fabrics in an alkaline detergent composition; (b) contacting the fabric with an optional bleaching composition; (c) contacting the fabric with the fabric conditioning agent and/or the softness boosting composition, such that the two composition are preferably dosed separately into the machine within the same rinse cycle, preferably in the last final rinse solution; (d) optionally rinsing the fabric and draining the fabric; and (e) drying the fabric. In a further exemplary method, previously laundered and/or bleached fabrics may be softened according to the invention. In such methers, the following general steps will take place: (a) contacting the fabric with the fabric conditioning agent and/or the softness boosting composition, such that the two composition are preferably dosed separately into the machine within the same rinse cycle, preferably in the last final rinse solution; (b) optionally rinsing the fabric and draining the fabric; and (c) drying the fabric.

In an aspect, the step of washing the fabrics in a detergent includes the use of a detergent having a pH range of about 7 to about 14. In an aspect, the washing of fabric has a wash pH greater than 9, or great than 10. The alkaline detergent may include additional bleaching and/or rinsing aid components as are customary in the field of industrial or institutional laundering applications. The present invention is not limited with respect to the detergency step of the application of use.

In an aspect, the step of contacting the fabric with a softness boosting compositions according to the invention include separate dosing of the composition form the fabric conditioning composition. In some aspects, the softness boosting composition is added prior to the addition of the fabric conditioning composition. Without being limited to a mechanism of action, in an exemplary method of use, a clay-based softness boosting composition is added first to fabric to allow the clay to contact the fabric prior to adding the positively-charged quaternary ammonium compound-containing fabric conditioning composition. The separation of the dosing may be for a matter of a few seconds to a few minutes, such as from about 1 minute to about 5 minutes, or preferably from about 2 minutes to about 3 minutes.

In an aspect, the step of contacting the fabric with a liquid or solid fabric conditioning composition includes adding the composition to a dryer containing washed fabrics after the first step of washing the fabrics. The fabric conditioning composition may comprise, consist of and/or consist essentially of (i) a silicone compound, preferably an amino-functional silicone, (i) an quaternary ammonium compound, and (iii) optionally one or more agents selected from the group consisting of water, surfactant, viscosity controlling agent, fragrance, anti-static agent, dye transfer inhibition/color protection agent, odor removal/odor capturing agent, soil shielding/soil releasing agent, ultraviolet light protection agents, sanitizing agent, disinfecting agent, water repellency agents, insect repellency agent, anti-pilling agents, souring agent, mildew removing agent, enzyme, allergicide agent, starch agent, bleaching agent, optical brightness agent, dye scavengers, molecular chelants, sequestering agents and mixtures thereof.

The dosing of the softness boosting composition and the fabric conditioning composition can be in a liquid, powder or solid composition (or combinations of the same as between the two compositions). The compositions can be delivered via various methods as are customary for industrial and institutional laundering operations. Both liquid and solid capsules and/or blocks are preferred delivery methods. While all delivery methods work to deliver the compositions to the fabric, it is believed that liquid delivery methods lead to higher levels of deposition of the compositions on the fabric.

In some aspects, the methods do not require a rinse and/or draining step before drying.

In an aspect, the step of adding the softness boosting composition and the fabric conditioning composition in a rinse cycle include the combining of the compositions having a use pH from about 2 to about 8 (fabric conditioning composition) and from a pH of about 2 to about 10 (the softness boosting composition).

In an aspect, the step of drying the fabric brings the fabric temperature to about 200 degrees Fahrenheit or greater. In other aspects, the drying step increases the softness of the fabric in comparison to a control. In other aspects the drying step provides a $\Delta b^*$ of fabric greater (more negative) than the $\Delta b^*$ of a control when subjected to at least 6 cycles washing cycles (includes wash step followed by a conditioning/softening step and drying). 2. The method of conditioning fabric according to claim 1 comprising a step of washing the fabric in a wash pH greater than 9 before contacting the fabric with the fabric conditioning composition.

The softening booster compositions are intended for use in combination with fabric conditioning compositions for improved softness. However, the methods of the invention are not limited to softening. The benefits of the present invention can also include reduced yellowing and/or maintained whiteness. It is generally desirable for laundry that is dried to remain white even after multiple drying cycles. That is, it is desirable that the fabric not yellow after repeated cycles of drying in the presence of the fabric conditioning composition. Whiteness retention can be measured according to $\Delta b$, for example, using a Hunter Lab instrument. In general, it is desirable to exhibit a lower $\Delta b$ (less yellow) for the fabric treated with the composition of the invention and dried at elevated temperatures, after 6 wash, soften, and drying cycles.

Additional benefits according to the invention may include fabric life extension, enhanced fragrance, anti-static properties as well as anti-wrinkling properties. The softening boosters and/or fabric conditioning compositions can include at least one of anti-static agents, anti-wrinkling agents, improved absorbency, dye transfer inhibition/color protection agents, odor removal/odor capturing agents, soil shielding/soil releasing agents, ease of drying, ultraviolet light protection agents, fragrances, sanitizing agents, disinfecting agents, water repellency agents, insect repellency agents, anti-pilling agents, souring agents, mildew removing agents, enzymes, starch agents, bleaching agents, optical brightness agents, allergicide agents, dye scavengers, molecular chelants, sequestering agents and mixtures thereof.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The following Examples set forth evaluation of various softening booster compositions, including clay softening booster compositions, quaternary softening booster compositions, and sucrose ester softening booster compositions.

Example 1

Softness Panel Testing. It is generally desirable for fabric treated in a dryer using the fabric conditioning composition of the invention to possess a softness preference that is at least comparable to the softness preference exhibited by commercially available solid fabric softeners. The softness preference is derived from a panel test with one-on-one comparisons of fabric (such as towels) treated with the fabric treatment composition according to the invention or with a commercially available solid fabric softener. In general, it is desirable for the softness preference resulting from the fabric treatment composition to be superior to the softness preference exhibited by commercially available solid fabric softeners.

Various softening boosters according to the invention were evaluated for efficacy employing the following procedures.

Scour Procedure:

Unless otherwise stated, all wash and rinse procedures were run in a 35 pound Milnor washing machine using 5 grain water. New white cotton terry towels, each having an approximate weight of about 0.5 kg, purchased from Institutional Textiles were scoured to remove from the fabric any processing aids used during manufacturing. The scouring was accomplished according to the following procedure:

Step One:

(a) A first low water level wash of about 12 gallons was undertaken for 20 minutes at 130 degrees Fahrenheit. 70 grams L2000XP detergent available from Ecolab of St. Paul, Minn. was used for the first low water level wash. The L2000XP detergent is an alkaline detergent. The water was drained from the wash tub. (b) A second low water level wash of about 12 gallons was undertaken for 10 minutes at 120 degrees Fahrenheit using 70 g L2000XP detergent. The wash water was drained from the tub. (c) A first high water level rinse of about 15 gallons was undertaken for 3 minutes. The water rinse water temperature was 120 degrees Fahrenheit. The water was drained from the wash tub. (d) A second high water level rinse of about 15 gallons at 90 degrees Fahrenheit was undertaken for 3 minutes and the water was drained. (e) A third high water level rinse of about 15 gallons at 90 degrees F. was undertaken for 3 minutes and the water was drained. (f) A fourth high water level rinse of about 15 gallons at 90 degrees F. was undertaken for 3 minutes and the water was drained. (g) A five minute extract was undertaken where the wash tub was spun to remove excess water.

The Step one is repeated to provide a 2× scouring procedure.

Step Two:

Substeps (a) and (b) from Step One were repeated without the addition of the L2000XP detergent. Substeps (c) through (g)—rinse through extract—from Step One were repeated.

Step Three:

The wet towels were placed in a Huebsch dryer, Stack 30 Pound (300 L) Capacity and the towels were dried on the high setting for 50 to 60 minutes such that the fabric temperature reached about 200 degrees Fahrenheit. If a larger load of towels was scoured, the time was increased. Towels had no remaining free water after Step Three was completed.

Washers: The washers were cycled through a high temperature 'rinse' cycle to remove any detergent residue before the softness testing begins. A minimum of 5 cycles are needed for detectable differences in softness.

Dryers: Drying time for full loads (80% or more) is 60 minutes on high (shorter time if larger dryer).

Towels are stored prior to the softness evaluation such that the last cycle of the experiment is completed the day before panel testing. Towels are folded in a consistent manner and placed inside a sealed container immediately following removal from dryer. The temperature of the sealed container is between 65 degrees Fahrenheit and 75 degrees Fahrenheit with a relative humidity of 40%-50%. The towels are equilibrated by remaining at these settings for about 24 hours prior to the panel testing.

Towels are paired by weight; difference of no more than/no less than 0.25 g to 0.5 g in weight from towel to towel within each pair. A minimum of 20 panelists are employed to obtain statistically significant data points. Panelists thoroughly wash and dry their hands (or use alcohol based hand sanitizer) immediately prior to panel testing, without using any lotion or other moisturizers.

Towel pairings for 2, 3 and 4 variable evaluations are as follows:

| 2 Variables | |
|---|---|
| Order | Pair |
| 1 | A:B |
| 2 | B:A |
| 3 | B:A |
| 4 | A:B |

| 3 Variables | |
|---|---|
| Order | Pair |
| 1 | A:C |
| 2 | B:C |
| 3 | A:B |
| 4 | C:B |
| 5 | C:A |
| 6 | B:A |
| 7 | B:C |
| 8 | B:A |
| 9 | C:A |
| 10 | A:B |
| 11 | A:C |
| 12 | C:B |

| 4 Variables | |
|---|---|
| Day 1: | |
| Order | Pair |
| 1 | D:A |
| 2 | B:C |
| 3 | D:B |
| 4 | A:C |
| 5 | C:D |
| 6 | B:A |
| 7 | A:D |
| 8 | C:B |
| 9 | B:D |
| 10 | C:A |
| 11 | D:C |
| 12 | A:B |
| Day 2: | |
| Order | Pair |
| 1 | A:B |
| 2 | D:C |
| 3 | C:A |
| 4 | B:D |
| 5 | C:B |
| 6 | A:D |
| 7 | B:A |
| 8 | C:D |
| 9 | A:C |
| 10 | D:B |
| 11 | B:C |
| 12 | D:A |

Panelists touch/handle both towels (in the same manner) in each pairing and choose which towel in each set has preferred softness. Towels are arranged next to each other in pairs (randomly) to account for any possible 'handed' basis of the panelist. One towel must be selected from each pair; if there is truly no difference the result is shown as pairs are equal. As towels increase in softness rating with repeated handling (transfer of natural oils, etc.) towels are refolded to expose new, unhandled surface after each 8-10 persons.

Baseline testing (2 rounds) was completed using the following products shown in Tables 2-3:

TABLE 2

| Sample | Product | Grams | Rank Sum |
|---|---|---|---|
| A | Equal doses: Market Leading Consumer anionic surfactant containing Detergent, chlorine Bleach, conventional quat based Softener | 78/70/52 | 411 |
| B | Recommended doses: Market Leading Consumer anionic surfactant containing Detergent, chlorine Bleach, conventional quat based Softener | 33/70/21 | 358 |
| C | L2000/Bleach/Clearly Soft | 90/70/52 | 527 |

As referred to herein the "Market Leading Consumer anionic surfactant containing Detergent, chlorine Bleach, conventional quat based Softener" is a commercially-available combination of products, including near neutral detergent (approximately pH 8), bleach and softening composition.

As shown in Table 2, testing using 28 pounds of linen resulted in the clear preference/winner of L2000 XP detergent (Ecolab, Inc., St. Paul, Minn.), bleach and Clearly Soft (Ecolab, Inc., St. Paul, Minn.). The rankings shown reflect a sum of scores wherein the higher values indicate softer panel ratings.

TABLE 3

| Sample | Product | Grams | Rank Sum |
|---|---|---|---|
| A | Equal doses: Market Leading Consumer anionic surfactant containing Detergent, chlorine Bleach, conventional quat based Softener | 78/70/52 | 261 |
| B | Recommended doses: Market Leading Consumer anionic surfactant containing Detergent, chlorine Bleach, conventional quat based Softener | 33/70/21 | 227 |
| C | L2000/Bleach/ClearlySoft | 90/70/52 | 340 |

As shown in Table 3, testing using 16 new towels again resulted in the clear preference/winner of L2000 XP detergent (Ecolab, Inc., St. Paul, Minn.), bleach and Clearly Soft (Ecolab, Inc., St. Paul, Minn.).

Trials employing softening boosters according to the invention were thereafter evaluated.

TABLE 4

| Sample | Product | Grams | Booster | Grams of Booster | Actives to Softener Ratio |
|---|---|---|---|---|---|
| A | L2000/Bleach/ Clearly Soft | 90/70/52 | Rewopol WE-5 (Evonik) (10% soln) | 26 | 5 |

TABLE 4-continued

| Sample | Product | Grams | Booster | Grams of Booster | Actives to Softener Ratio |
|---|---|---|---|---|---|
| B | L2000/Bleach/ ClearlySoft | 90/70/52 | Arquad 2HT-75 (10% soln) di-hardened tallow quat (Akzo Nobel) | 26 | 5 |

As shown in FIG. 1, the softening using 5% actives booster on top of the Clearly Soft Product (for all tested boosters) resulted in a clear preference/winner of Arquad 2HT.

TABLE 5

| Sample | Product | Grams | Booster | Grams of Booster | Actives to Softener Ratio (%) |
|---|---|---|---|---|---|
| A | L2000/Bleach/ Clearly Soft | 90/70/52 | Ammonyx CETAC-30, cetyl trimethyl ammonium chloride (30% soln) (Stepan) | 8.7 | 5 |
| B | L2000/Bleach/ Clearly Soft | 90/70/52 | Sokalan HP20 (80% soln) PEI | 3.25 | 5 |
| C | L2000/Bleach/ Clearly Soft | 90/70/52 | Sisterna PS750-C (10% soln), sucrose palmitate | 26 | 5 |

Figure 2:
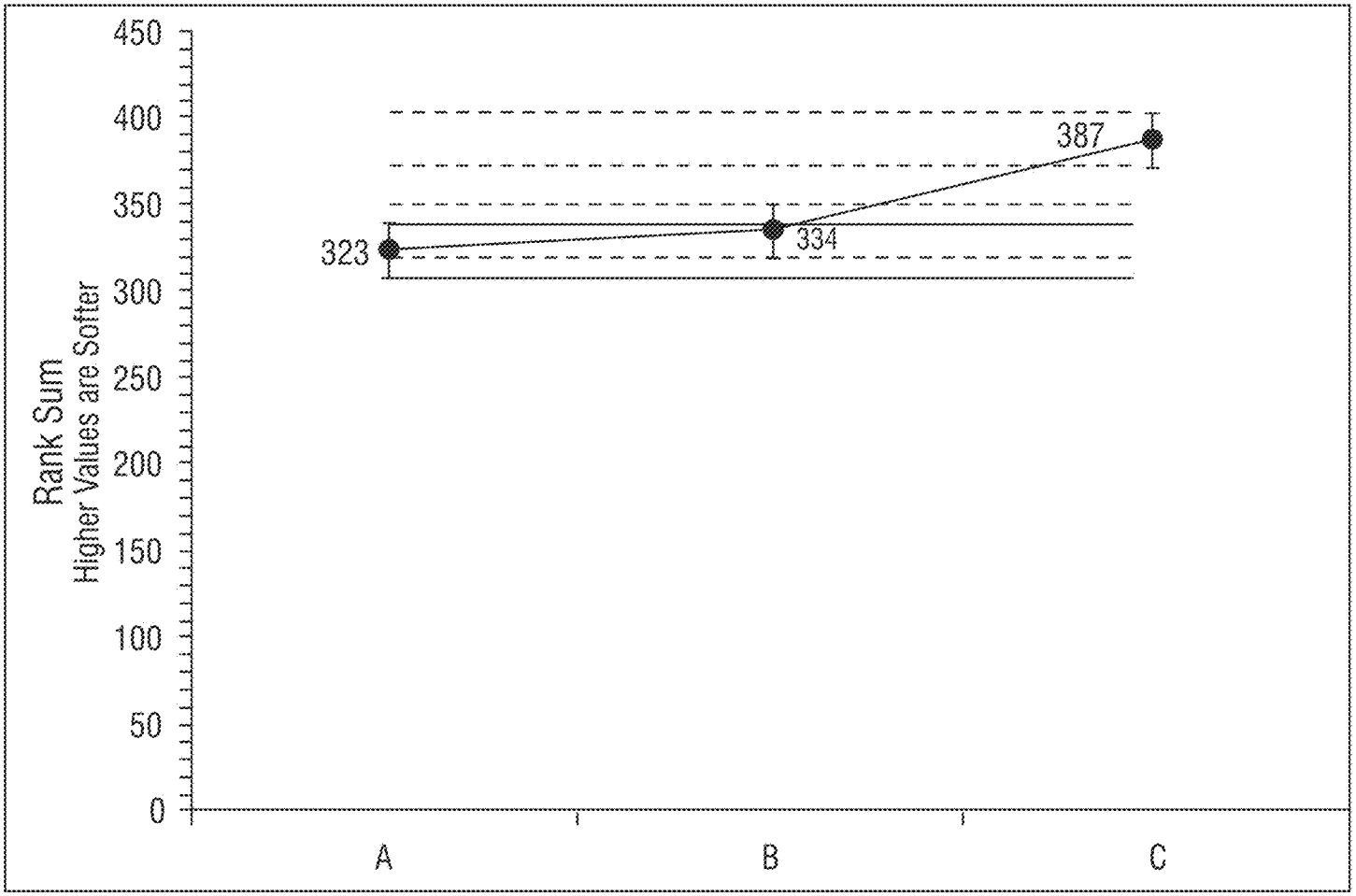

As shown in FIG. 2, the softening using 5% actives booster on top of the Clearly Soft Product (for all tested boosters) resulted in a clear preference/winner of Sisterna sucrose ester.

TABLE 6

| Sample | Product | Grams | Booster | Grams of Booster | Actives to Softener Ratio (%) |
|---|---|---|---|---|---|
| A | L2000/Bleach/ Clearly Soft | 90/70/52 | Gelwhite L clay (10% soln) | 26 | 5 |
| B | L2000/Bleach/ Clearly Soft | 90/70/52 | Laponite RDS clay (10% soln) | 26 | 5 |
| C | L2000/Bleach/ Clearly Soft | 90/70/52 | Benolite L clay (10% soln) | 26 | 5 |

Figure 3:
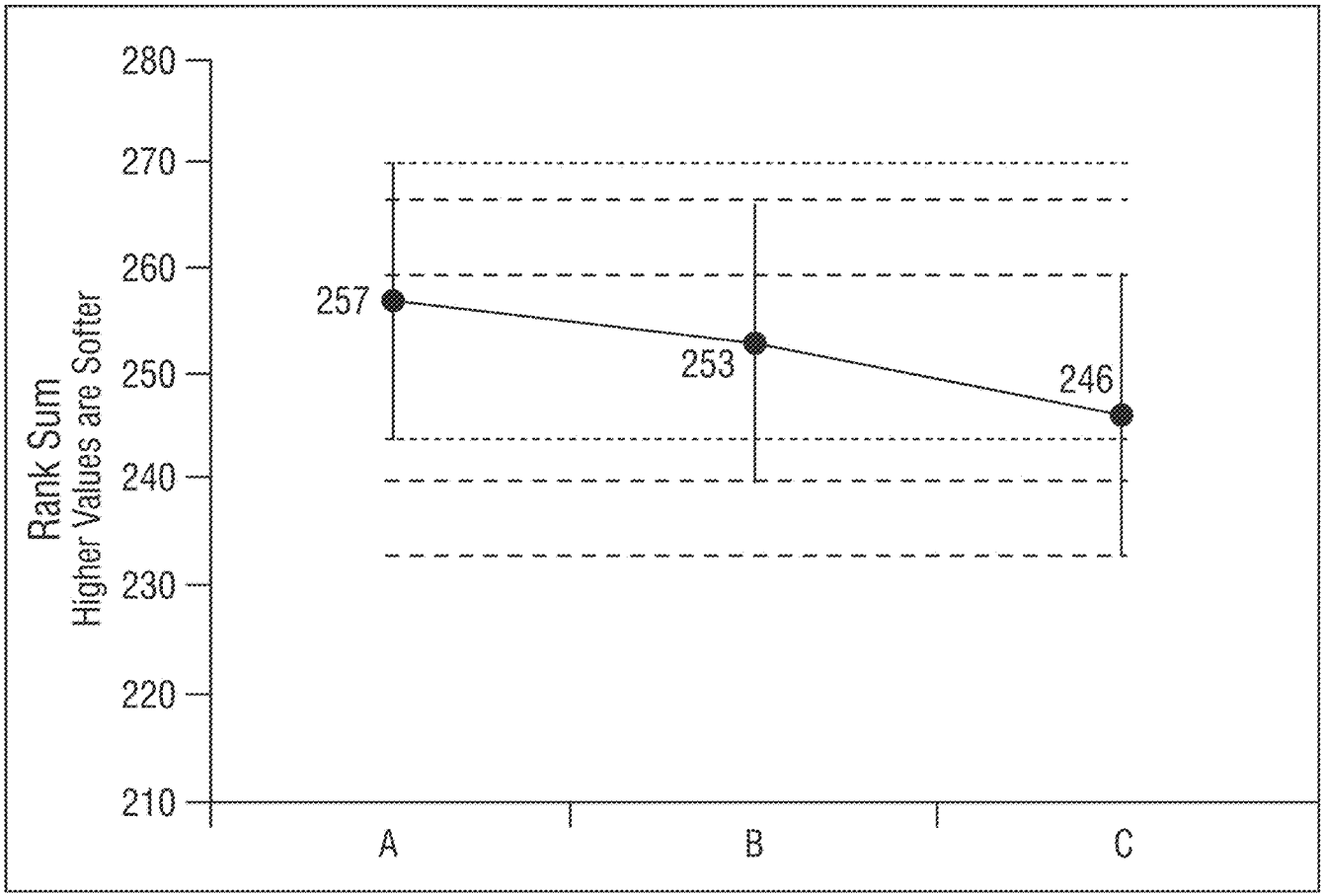

As shown in FIG. 3, the softening using 5% actives clay boosters on top of the Clearly Soft Product (for all tested boosters) resulted in favorable results for all clay softening boosters, not resulting in a clear winner. The clays were added to the last 2-3 minutes of the softening step/cycle.

TABLE 7

| Sample | Product | Grams | Booster | Grams of Booster | Actives to Softener Ratio (%) |
|---|---|---|---|---|---|
| A | L2000/Bleach/ Clearly Soft | 90/70/52 | Benolite DL clay (10% soln) | 26 | 5 |
| B | L2000/Bleach/ Clearly Soft | 90/70/52 | Gelwhite GP clay (10% soln) | 26 | 5 |
| C | L2000/Bleach/ Clearly Soft | 90/70/52 | Laponite RD (5% soln) | 26 | 5 |

Figure 4:
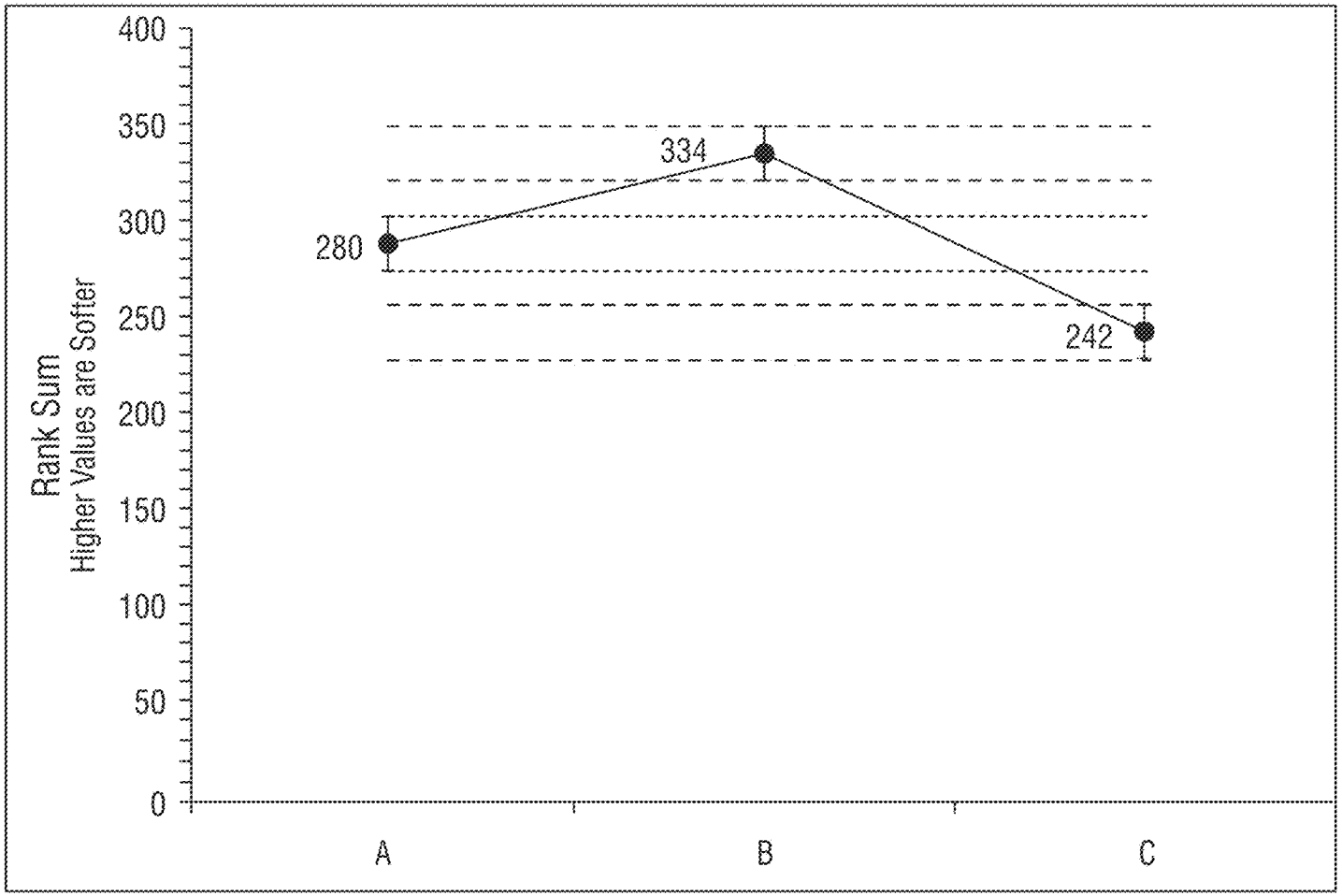

As shown in FIG. 4, the softening using 5% actives clay boosters on top of the Clearly Soft Product (for all tested boosters) resulted in favorable results for all clay softening boosters, with the clear winner being the Gelwhite L clay. There was a decrease in benefit/measured softness with the increase in dosing of the clay booster (C). The clays were added to the last 2-3 minutes of the softening step/cycle.

TABLE 8

| Sample | Product | Grams | Booster | Grams of Booster | Actives to Softener Ratio (%) |
|---|---|---|---|---|---|
| A | L2000/Bleach/ Clearly Soft | 90/70/52 | Clearly Soft Booster (20% soln) | 13 | 5 |
| B | L2000/Bleach/ Clearly Soft | 90/70/52 | Gelwhite GP clay (10% soln) | 26 | 5 |
| C | L2000/Bleach/ Clearly Soft | 90/70/52 | Lonza Barlox 16S (6% soln) cetyl amine oxide | 43 | 5 |

Figure 5:
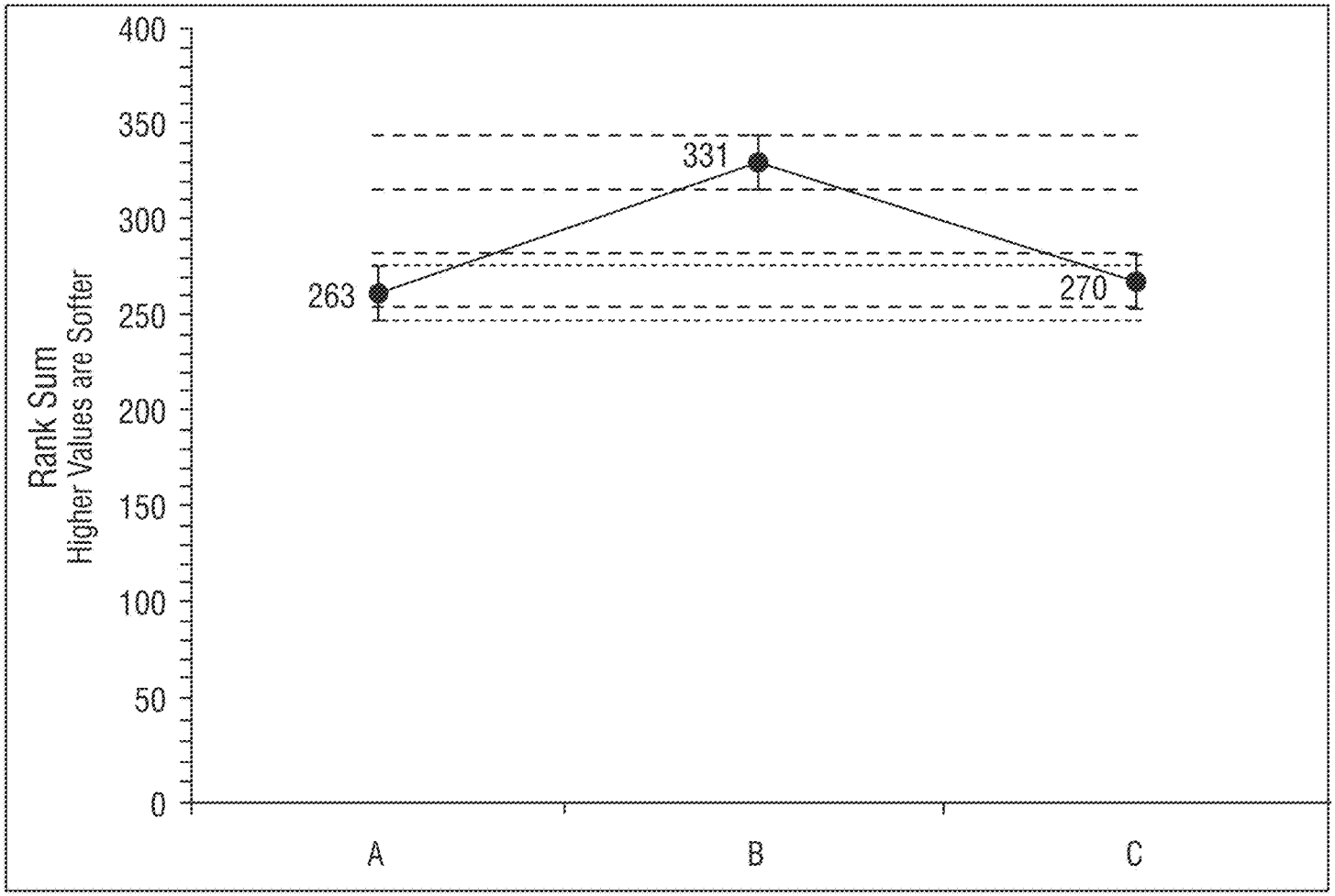

As shown in FIG. 5, the softening using 5% actives boosters on top of the Clearly Soft Product (for all tested boosters) resulted in the clear winner being the Gelwhite OP clay. This was a repeat of prior testing with the flip of softening/clay addition; there was a split fabric softener step for Gelwhite GP, which was added and mixed in the wash wheel for the first 3 minutes of the step, then Clearly Soft was added and mixed in the wash wheel for the last 3 minutes.

TABLE 9

| Sample | Product | Grams | Booster | Grams of Booster | Actives to Softener Ratio |
|---|---|---|---|---|---|
| A | L2000/Bleach/ Clearly Soft | 90/70/52 | Gelwhite L clay (10% soln) | 26 | 5 |
| B | L2000/Bleach/ Clearly Soft | 90/70/52 | Accosoft 365 (100%) tallow polyethoxy ammonium methyl sulfate (Stepan) | 2.6 | 5 |
| C | L2000/Bleach/ Clearly Soft | 90/70/52 | Aquanese starch 8305 (5.4% soln) cationic modified starch | 48.1 | 5 |

Figure 6:
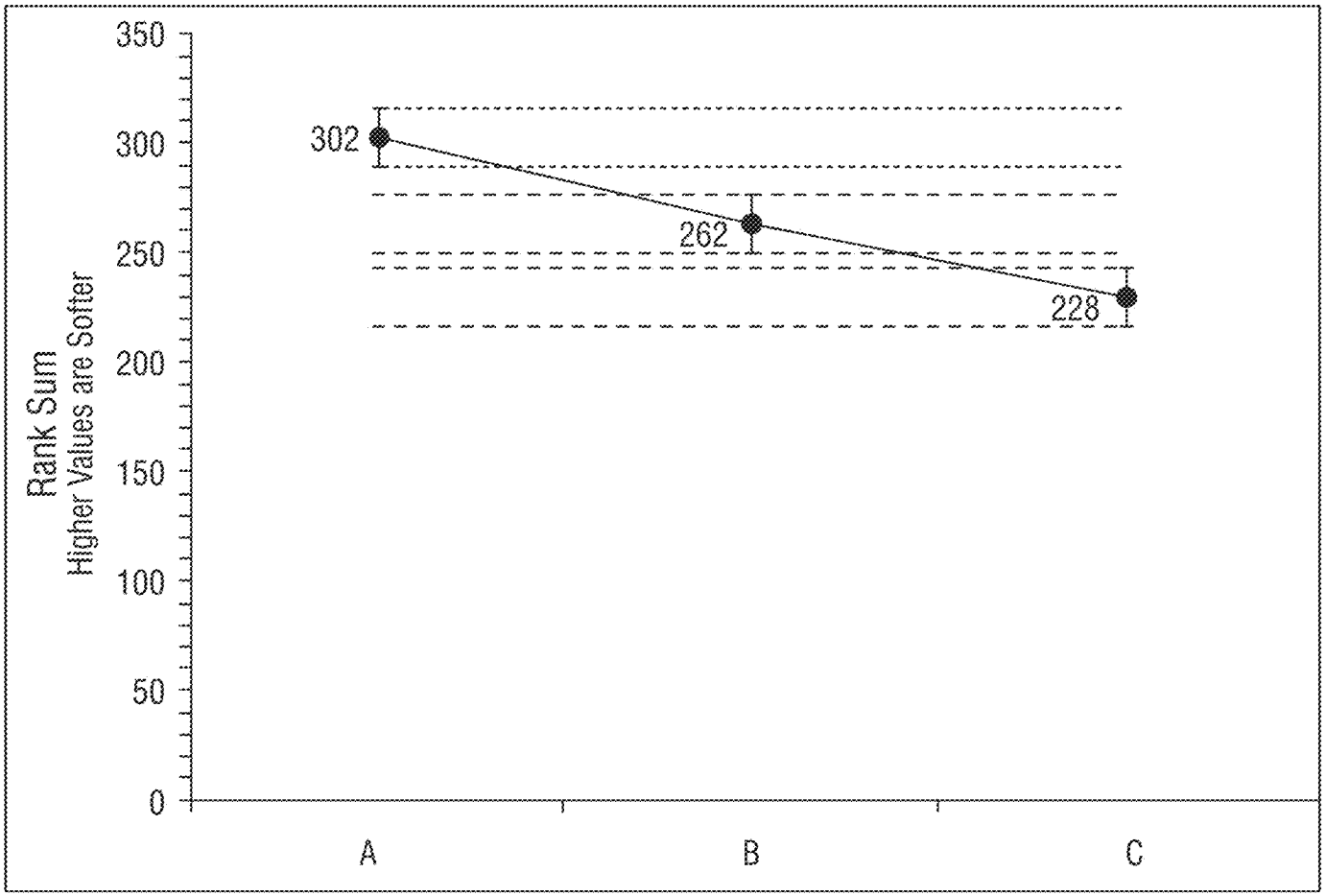

As shown in FIG. 6, the softening using 5% actives boosters on top of the Clearly Soft Product (for all tested boosters) resulted in the clear winner being the Gelwhite GP clay. This was another repeat of prior testing with the flip of softening clay addition; there was a split fabric softener step for Gelwhite GP, which was added and mixed in the wash wheel for the first 3 minutes of the step, then Clearly Soft was added and mixed in the wash wheel for the last 3 minutes.

TABLE 10

| Sample | Product | Grams | Booster | Grams of Booster | Actives to Softener Ratio (%) |
|---|---|---|---|---|---|
| A | L2000/Bleach/ Clearly Soft | 90/70/52 | Sisterna PS750-C (10% soln) | 26 | 5 |
| B | L2000/Bleach/ Clearly Soft | 90/70/52 | None | 0 | 0 |
| C | L2000/Bleach/ Clearly Soft | 90/70/52 | Colonial ColaSolv IES (10% soln), isostearyl ethylimidazolinium ethosulfate | 26 | 5 |

Figure 7:
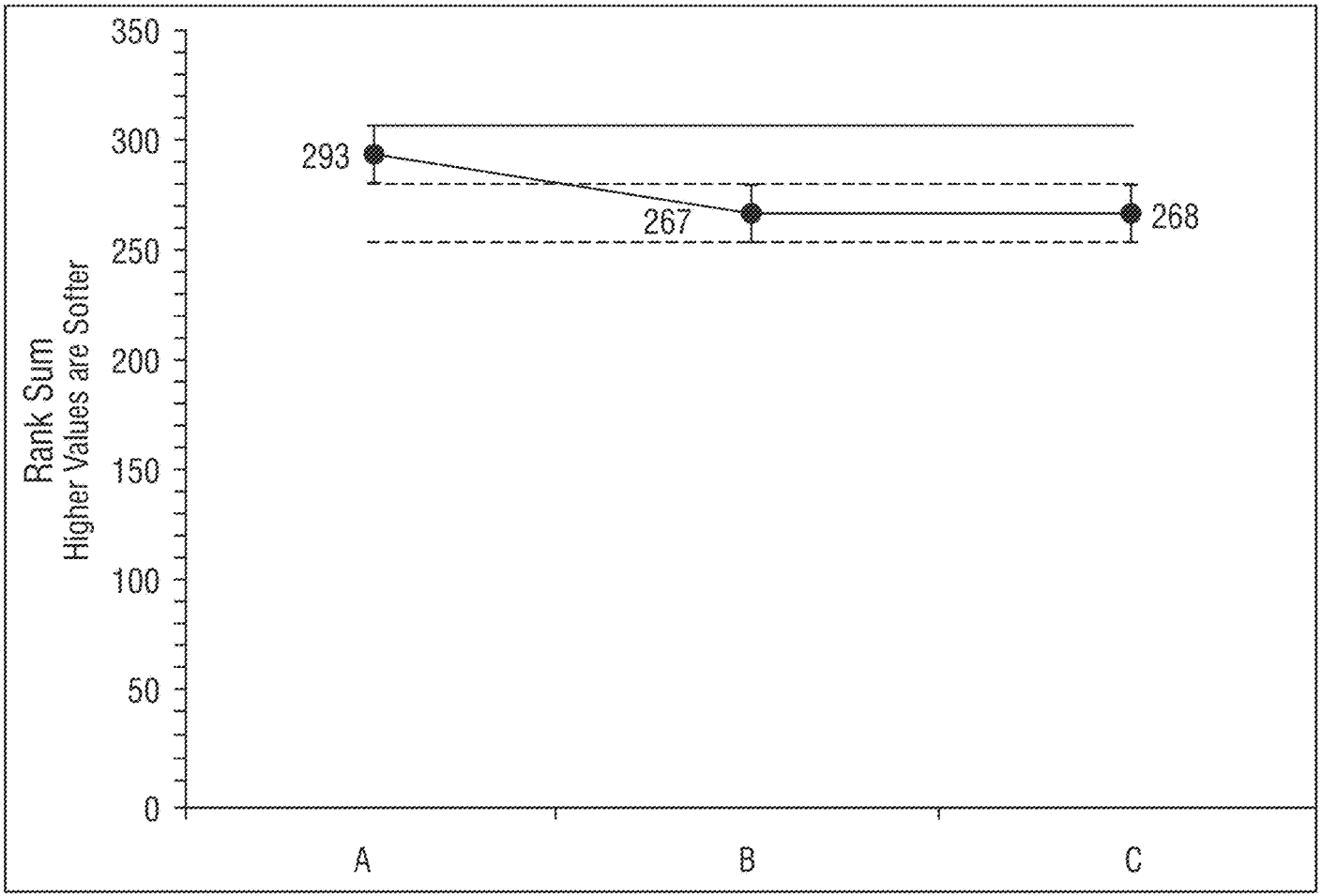

As shown in FIG. 7, the softening using 5% actives boosters on top of the Clearly Soft Product (for all tested boosters) resulted in the clear winner being the Sisterna sucrose ester.

TABLE 11

| Sample | Product | Grams | Booster | Grams of Booster | Actives to Softener Ratio (%) |
|---|---|---|---|---|---|
| A | L2000/Bleach/ Clearly Soft | 90/70/52 | Clearly Soft | 52 | 100 |

TABLE 11-continued

| Sample | Product | Grams | Booster | Grams of Booster | Actives to Softener Ratio (%) |
|---|---|---|---|---|---|
| B | L2000/Bleach/ Clearly Soft | 90/70/52 | Arquad 2HT (10% soln) | 26 | 5 |
| C | L2000/Bleach/ Clearly Soft | 90/70/52 | Gelwhite GP (10% soln) | 62.4 | 12 |

Figure 8:
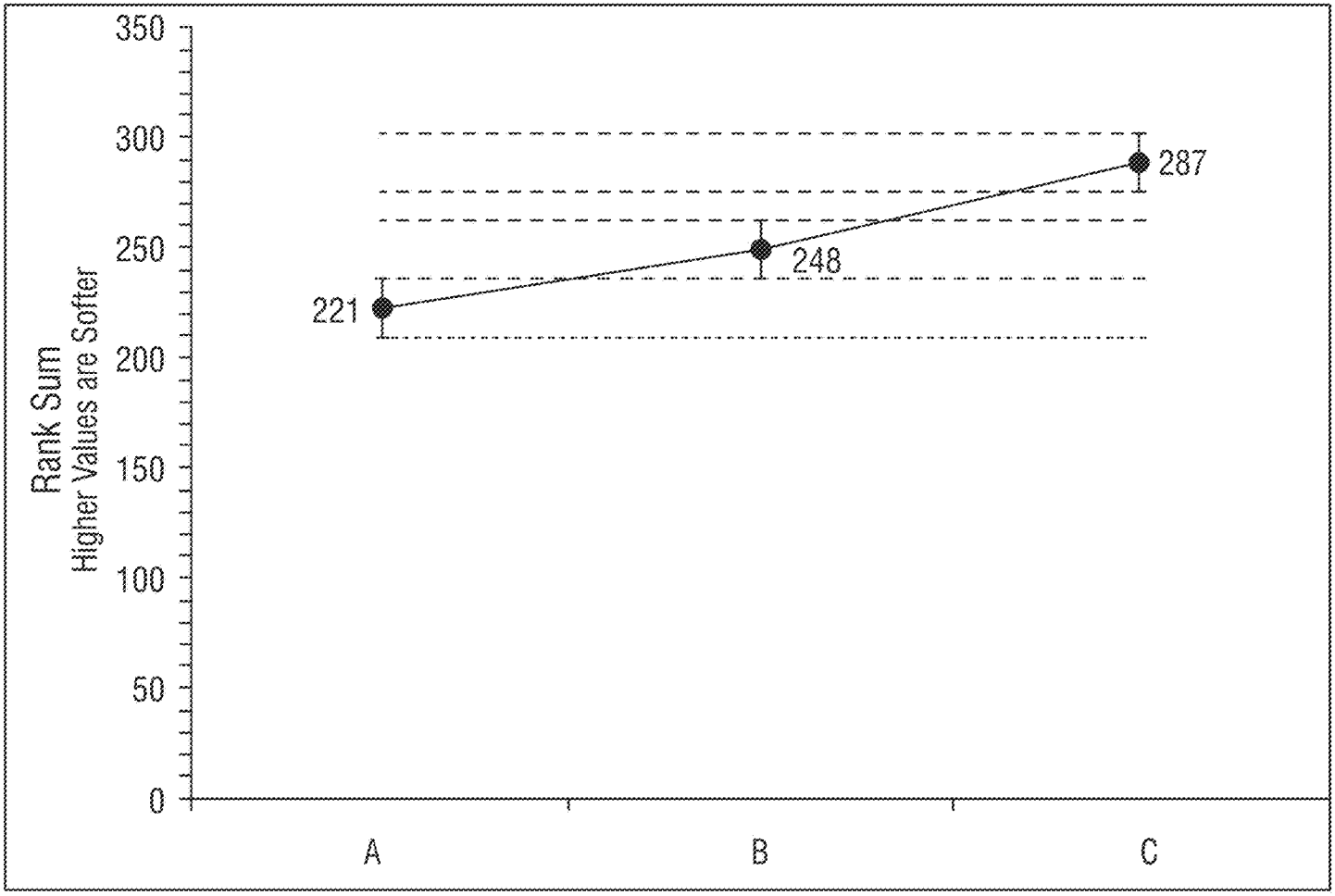

As shown in FIG. 8, the softening using 5% versus 12% actives booster on top of the Clearly Soft Product resulted in a clear preference/winner of Gelwhite GP at 12% actives. This was another repeat of prior testing with the flip of softening/clay addition; there was a split fabric softener step for Gelwhite GP, which was added and mixed in the wash wheel for the first 3 minutes of the step, then Clearly Soft was added and mixed in the wash wheel for the last 3 minutes.

TABLE 12

| Sample | Product | Grams | Booster | Grams of Booster | Actives to Softener Ratio |
|---|---|---|---|---|---|
| A | L2000/Bleach/ Clearly Soft | 90/70/52 | Sisterna PS750-C (10% soln) added at 5% actives | 26 | 5 |
| B | L2000/Bleach/ Clearly Soft | 90/70/52 | Sisterna PS750-C (10% soln) added at 10% actives | 52 | 10 |
| C | L2000/Bleach/ Clearly Soft | 90/70/52 | Gelwhite GP clay (10%) | 62.4 | 12 |

Figure 9:
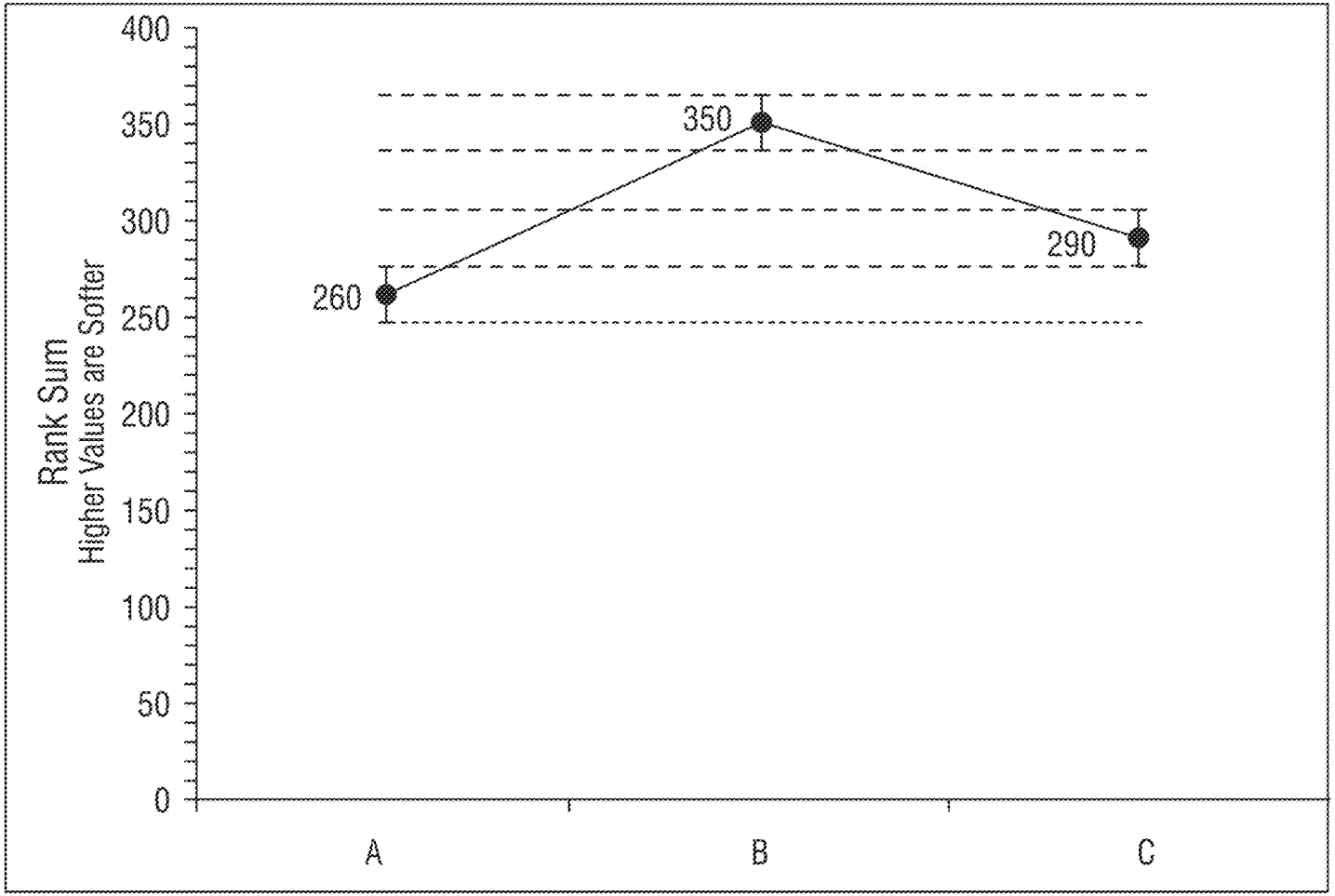

As shown in FIG. 9, the softening using 10% actives boosters on top of the Clearly Soft Product resulted in the clear winner over the 5% actives Sisterna sucrose ester.

TABLE 13

| Sample | Product | Grams | Booster | Grams of Booster | Actives to Softener Ratio |
|---|---|---|---|---|---|
| A | L2000/Bleach/ Clearly Soft | 90/70/52 | Arquad 2HT-75 (10% soln) added at 5% actives | 26 | 5 |
| B | L2000/Bleach/ Clearly Soft | 90/70/52 | Arquad 2HT-75 (10% soln) added at 10% actives | 52 | 10 |
| C | L2000/Bleach/ Clearly Soft | 90/70/52 | Gelwhite L clay (10%) added at 12% actives | 62.4 | 12 |

Figure 10:
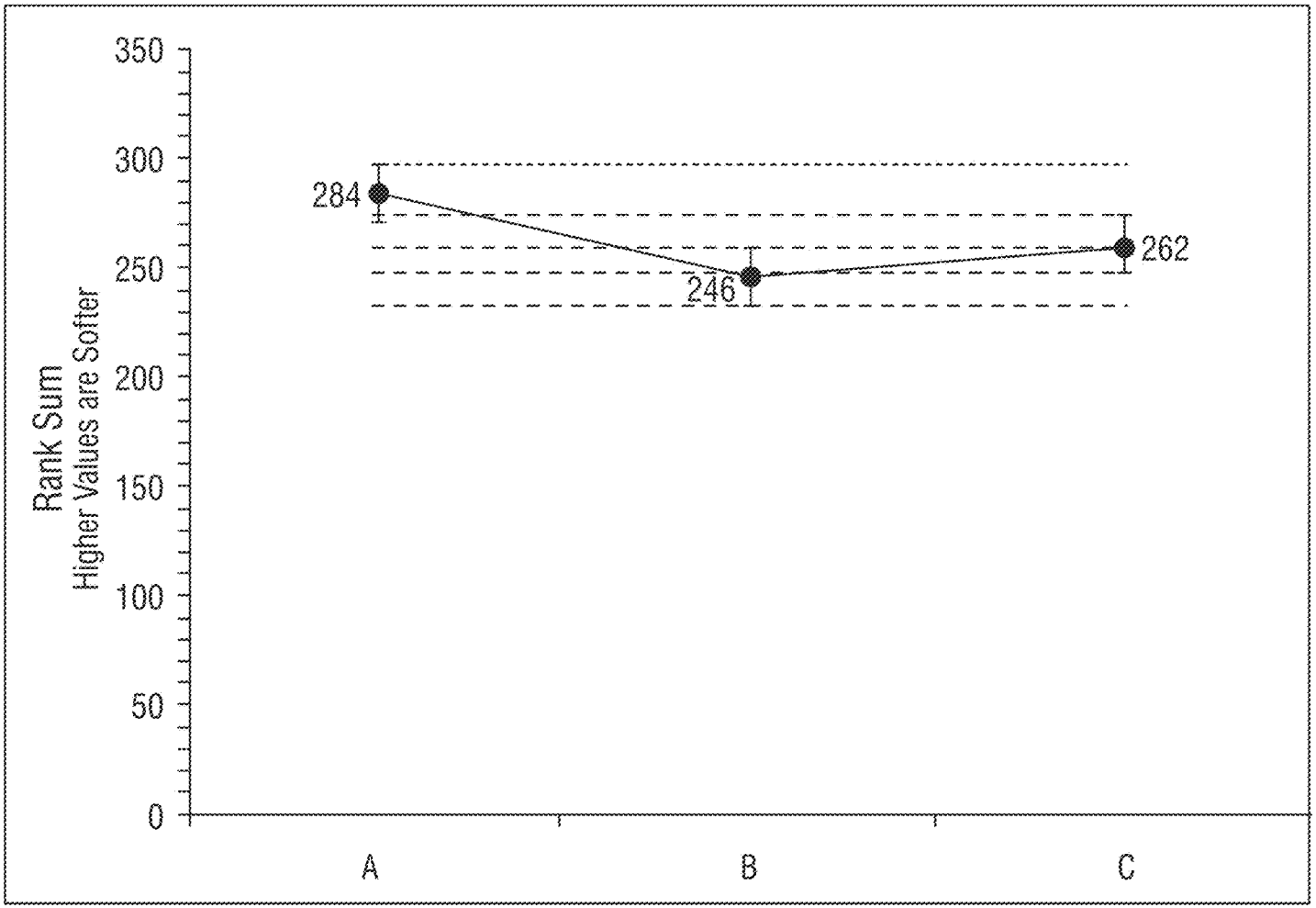

As shown in FIG. 10, the softening using 5% actives booster Arquad 2HT outperformed the higher actives of 10% and 12% Gelwhite GP clay on top of the Clearly Soft Product. Noticeable benefit was still seen with the Gelwhite GP clay. This was again conducted using a split fabric softening step for Gelwhite (as described above).

TABLE 14

| Sample | Product | Grams | Booster | Grams of Booster | Actives to Softener Ratio (%) |
|---|---|---|---|---|---|
| A | L2000/Bleach/ Clearly Soft | 90/70/52 | None | 0 | 0 |
| B | L2000/Bleach/ Clearly Soft | 90/70/52 | Gelwhite GP clay (10% soln) added at 12% actives | 62.4 | 12 |
| C | L2000/Bleach/ Clearly Soft | 90/70/52 | Gelwhite L clay (10% soln) added at 12% actives | 62.4 | 12 |

Figure 11:
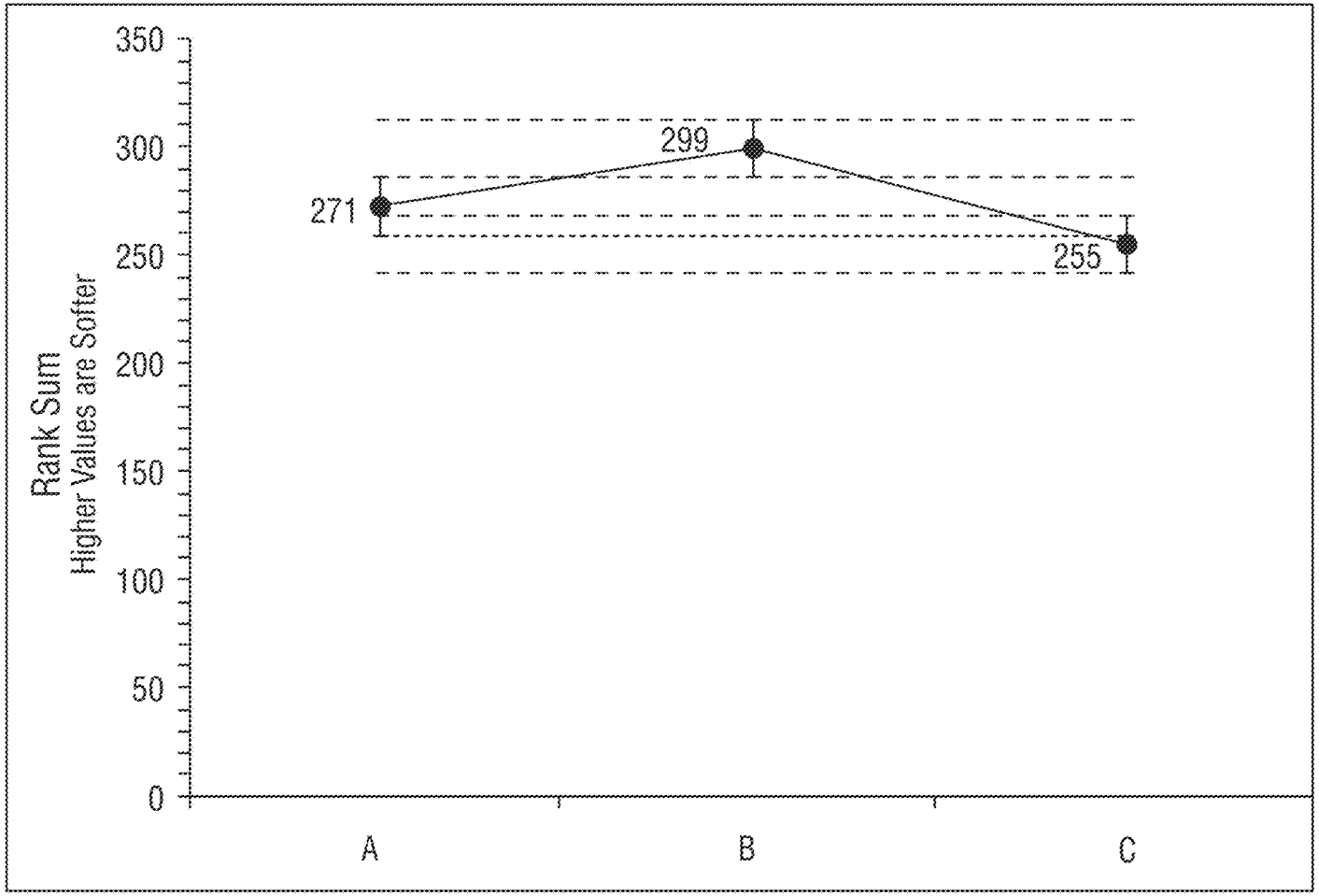

As shown in FIG. 11, the softening using 12% actives clay boosters on top of the Clearly Soft Product resulted in the clear winner. This was again conducted using a split fabric softening step for Gelwhite (as described above).

TABLE 15

| Sample | Product | Grams | Booster | Grams of Booster | Actives to Softener Ratio (%) |
|---|---|---|---|---|---|
| A | L2000/Bleach/ Clearly Soft | 90/70/52 | None | 0 | 0 |
| B | L2000/Bleach/ Clearly Soft | 90/70/52 | Sisterna PS750-C (10% soln) added at 10% actives | 52 | 10 |
| C | L2000/Bleach/ Clearly Soft | 90/70/52 | Arquad 2HT-75 (10% soln) added at 5% actives | 26 | 5 |
| D | L2000/Bleach/ Clearly Soft | 90/70/52 | Gelwhite GP clay (10% soln) added at 10% actives | 52 | 10 |

Figure 12:
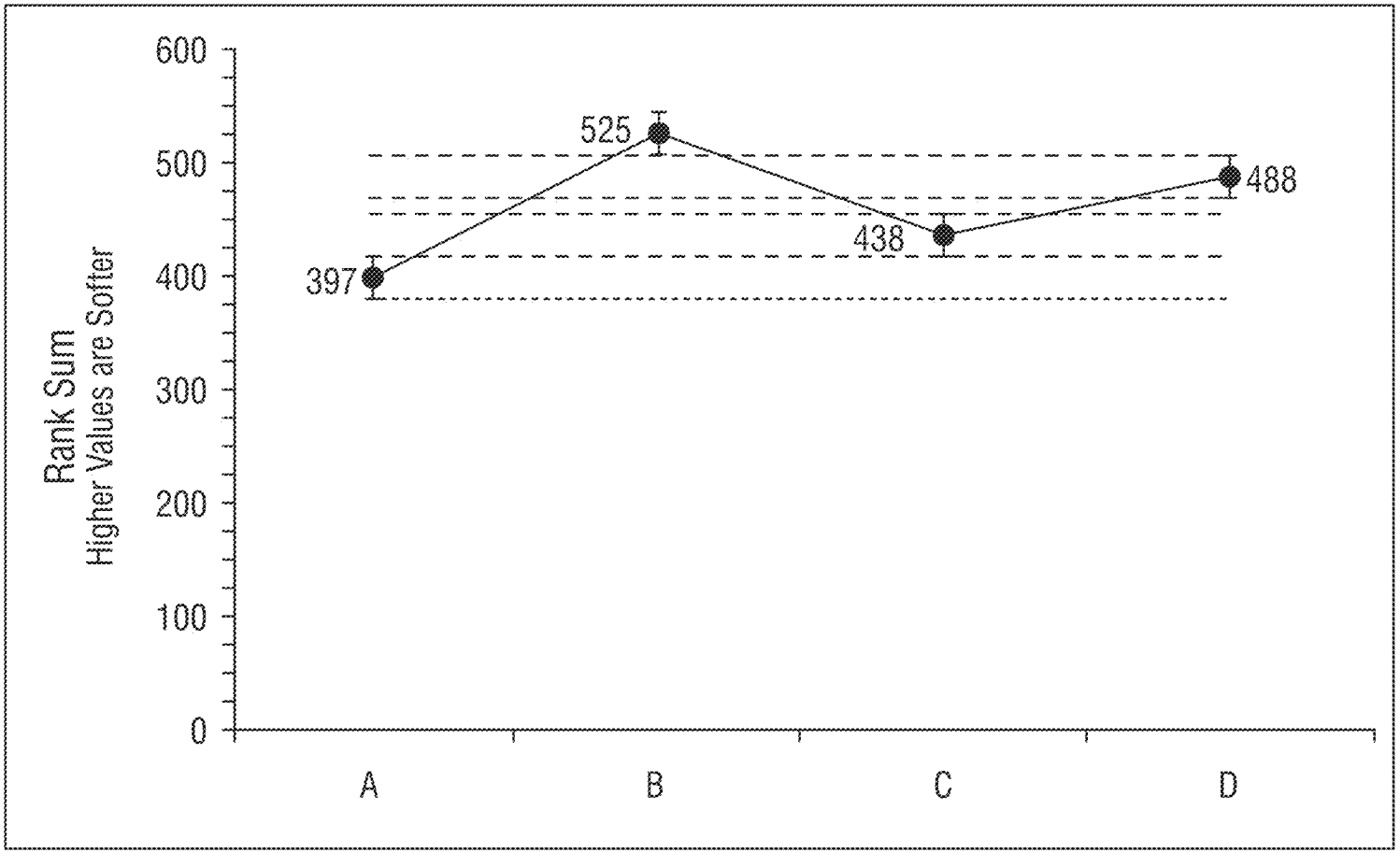

As shown in FIG. 12, the softening using 10% actives sucrose ester Sisterna booster on top of the Clearly Soft Product resulted in the clear winner, with a close second being the Gelwhite clay, which was again conducted using a split fabric softening step for Gelwhite (as described above).

TABLE 16

| Sample | Product | Grams | Booster | Grams of Booster | Actives to Softener Ratio (%) |
|---|---|---|---|---|---|
| A | L2000/Bleach/ SoFresh | 90/70/25 | None | 0 | 0 |
| B | L2000/Bleach/ SoFresh | 90/70/25 | Gelwhite GP clay (10% soln) added at 10% actives | 25 | 10 |
| C | L2000/Bleach/ SoFresh | 90/70/25 | Sisterna PS750-C (10% soln) added at 10% actives | 25 | 10 |
| D | L2000/Bleach/ SoFresh | 90/70/25 | Arquad 2HT-75 (10%) added at 5% actives | 12.5 | 5 |

Figure 13:
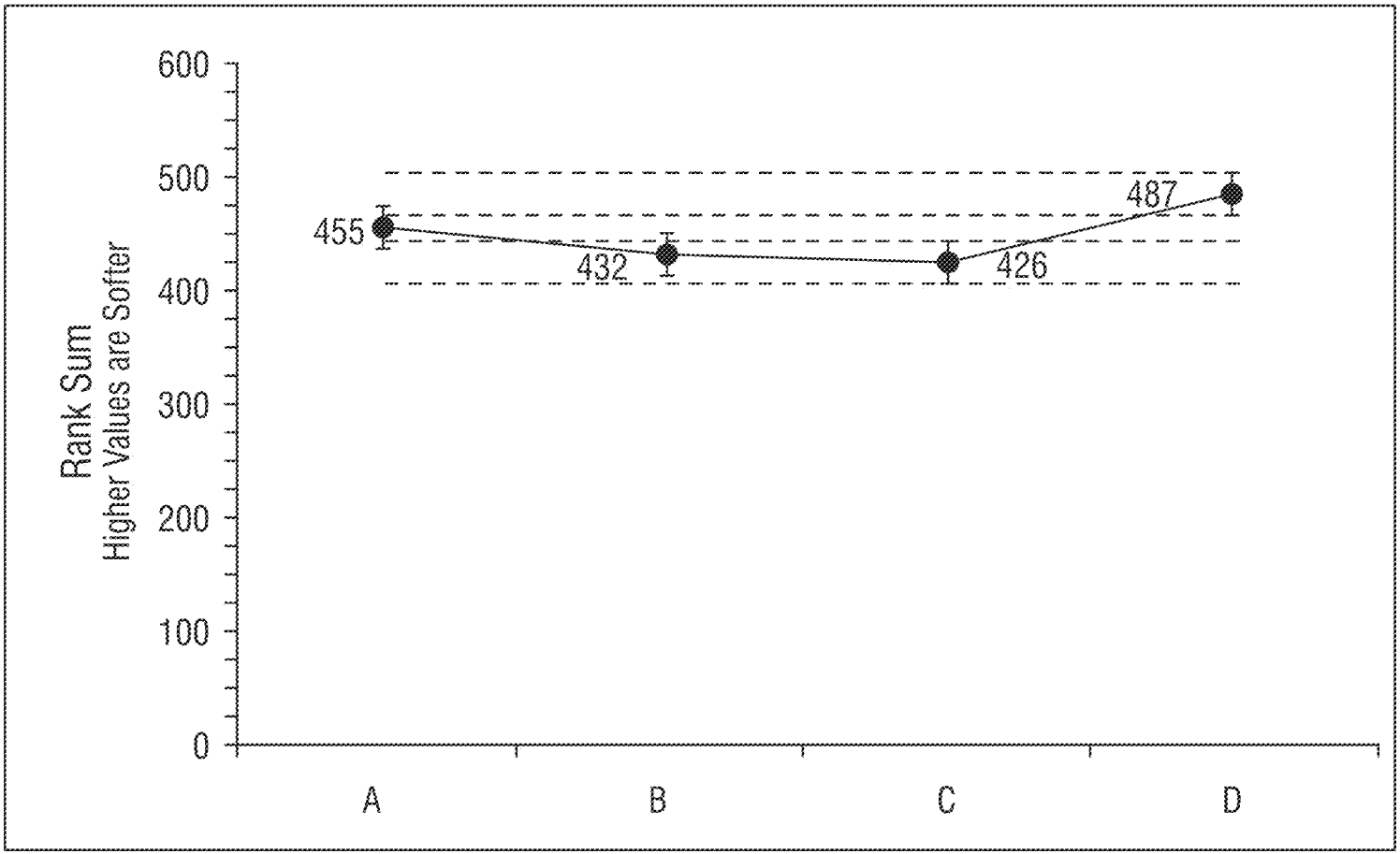

As shown in FIG. 13, the softening using 5% actives Arquad 2HT booster on top of the So Fresh Product resulted in the clear winner, which was again conducted using a split fabric softening step for Gelwhite (as described above).

SoFresh fabric softener was employed in the testing, containing a DHTDMAC (di-hardened tallow dimethyl ammonium chloride).

TABLE 17

| Sample | Product | Grams | Booster | Grams of Booster | Actives to Softener Ratio (%) |
|---|---|---|---|---|---|
| A | L2000/Bleach/ Clearly Soft | 90/70/52 | None | 0 | 0 |
| B | L2000/Bleach/ Clearly Soft | 90/70/52 | Sisterna PS750-C (10% soln) added at 10% actives | 52 | 10 |
| C | L2000/Bleach/ Clearly Soft | 90/70/52 | Sisterna PS750-C (10% soln) added at 10% actives with additional wash sucrose palmitate | 52 | 10 |

Figure 14:
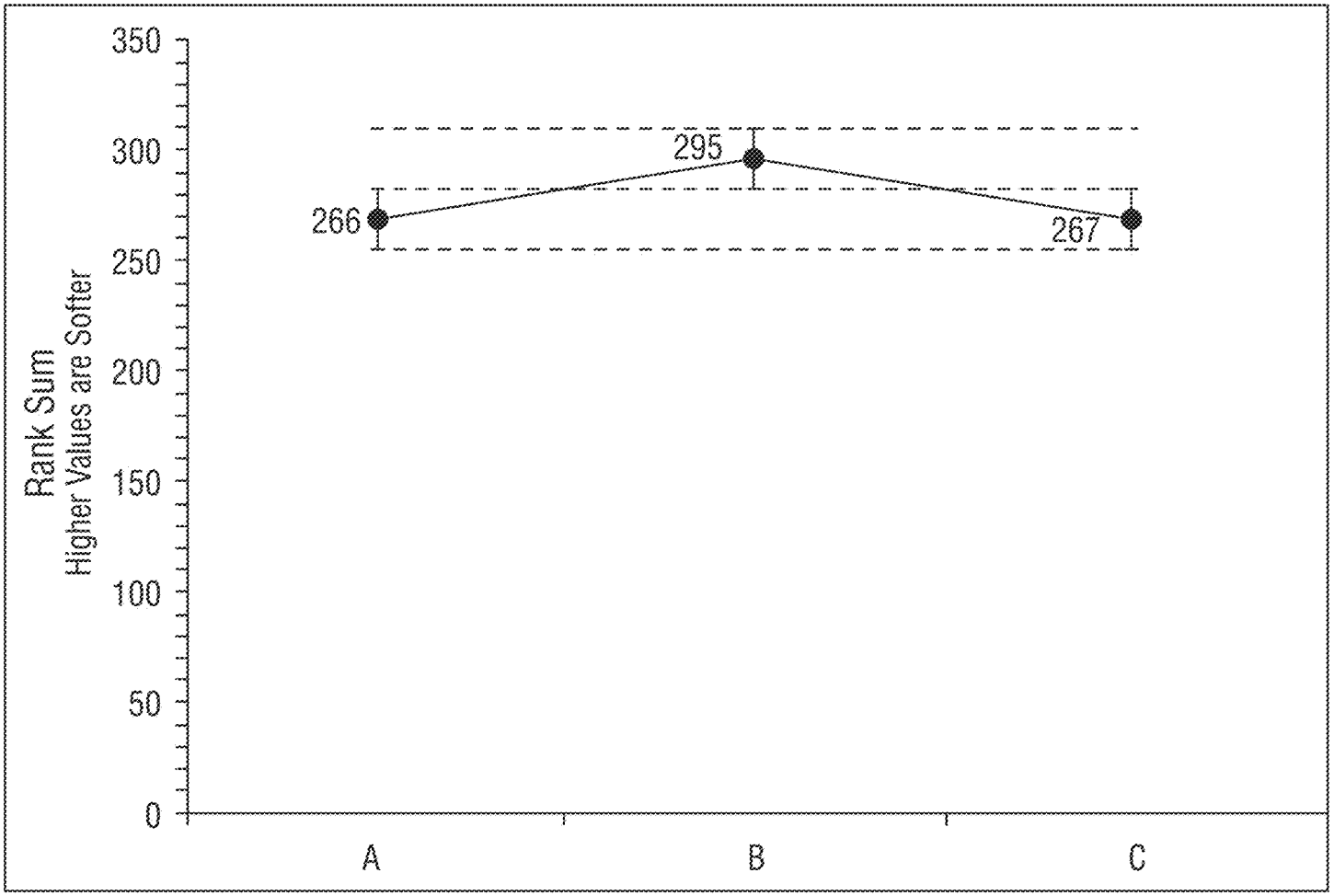

As shown in FIG. 14, the softening using 10% actives Sisterna sucrose esters resulted in the clear winner for softening booster.

TABLE 18

| Sample | Product | Grams | Booster | Grams of Booster | Actives to Softener Ratio (%) |
|---|---|---|---|---|---|
| A | L2000/Bleach/ Clearly Soft | 90/70/52 | Clearly Soft and Gelwhite GP clay (10% soln) added together at 5% actives | 26 | 5 |
| B | L2000/Bleach/ Clearly Soft | 90/70/52 | Clearly Soft added first, Gelwhite GP clay (10% soln) added second at 5% actives | 26 | |
| C | L2000/Bleach/ Clearly Soft | 90/70/52 | Gelwhite GP clay (10% soln) added first, Clearly Soft added second at 5% actives | 26 | 5 |

Figure 15:
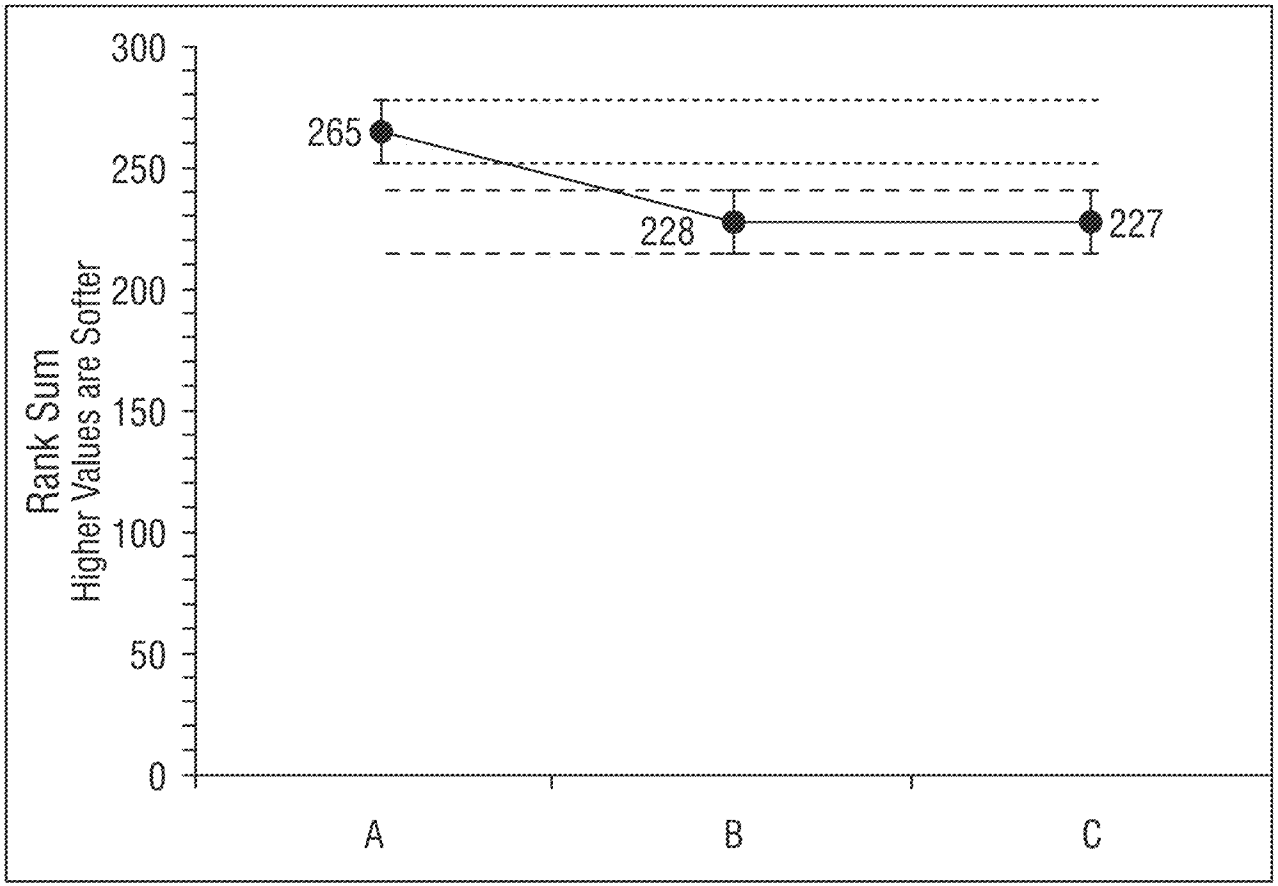

As shown in FIG. 15, the softening using Clearly Soft and Gelwhite GP clay (10%) added together at 5% actives resulted in the clear winner for softening booster.

TABLE 19

| Sample | Product | Grams | Booster | Grams of Booster | Actives to Softener Ratio (%) |
|---|---|---|---|---|---|
| A | L2000/Bleach/ Clearly Soft | 90/70/52 | Clearly Soft and Gelwhite GP clay (10% soln) added together at 10% actives | 52 | 10 |
| B | L2000/Bleach/ Clearly Soft | 90/70/52 | Gelwhite GP clay (10% soln) added first Clearly Soft added second at 10% actives | 52 | 10 |

TABLE 19-continued

| Sample | Product | Grams | Booster | Grams of Booster | Actives to Softener Ratio (%) |
|---|---|---|---|---|---|
| C | L2000/Bleach/ Clearly Soft | 90/70/52 | Clearly Soft added first, Gelwhite GP clay (10% soln) added second at 10% actives | 52 | 10 |

Figure 16:
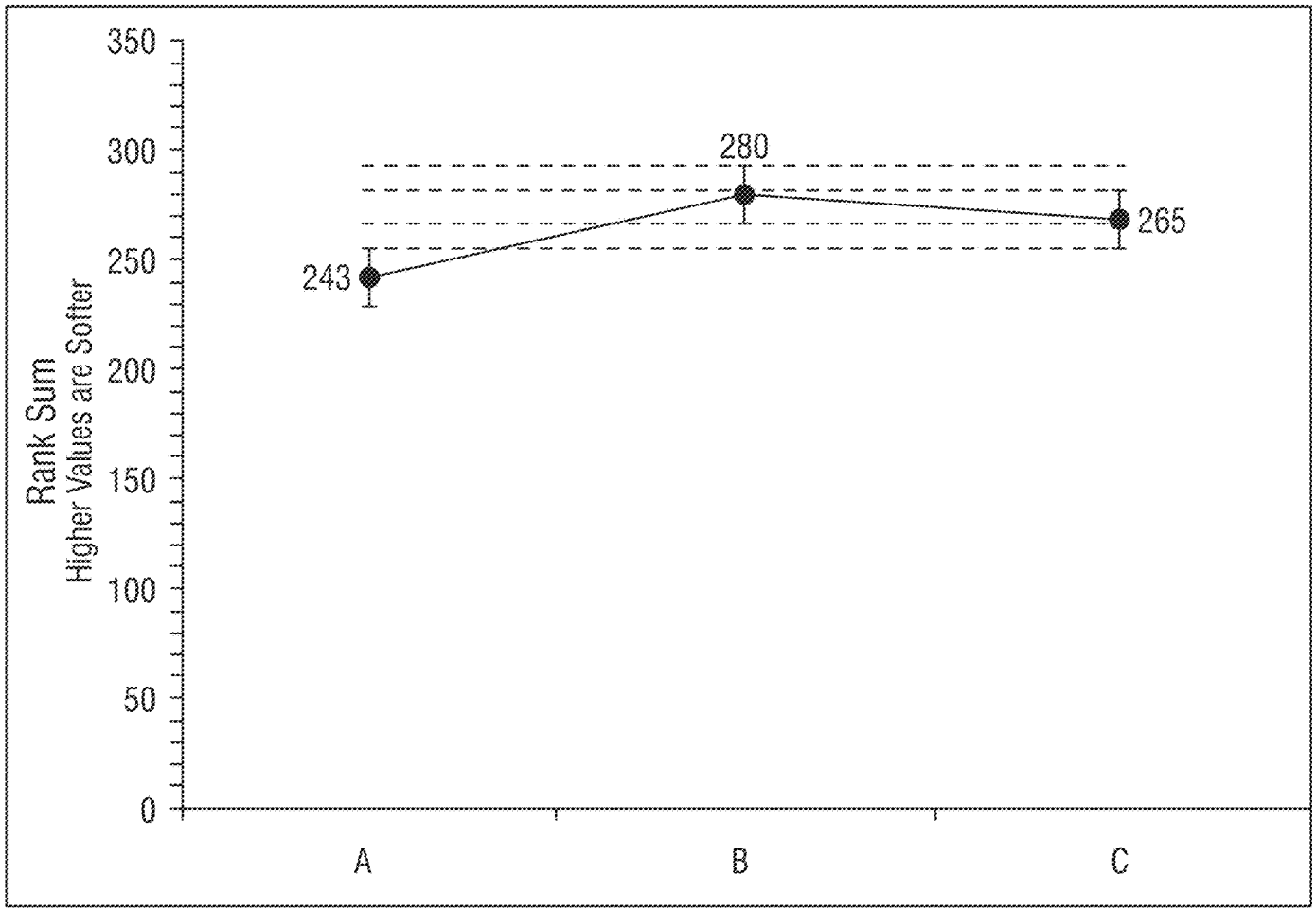

As shown in FIG. 16, the softening using Clearly Soft and Gelwhite GP clay (10%) added together at 10% actives was outperformed slightly by the addition of first Gelwhite GP clay followed by Clearly Soft. For these test a 12 minute softness cycle was employed (twice as long as other tests).

TABLE 20

| Sample | Product | Grams | Booster | Grams of Booster | Actives to Softener Ratio (%) |
|---|---|---|---|---|---|
| A | L2000/Bleach/ Clearly Soft | 90/70/52 | Sisterna PS750-C and Clearly Soft added together at 10% actives | 52 | 10 |
| B | L2000/Bleach/ Clearly Soft | 90/70/52 | Clearly Soft added first, Sisterna PS750-C added second at 10% actives | 52 | 10 |
| C | L2000/Bleach/ Clearly Soft | 90/70/52 | Sisterna PS750-C added first, Clearly Soft added second at 10% actives | 52 | 10 |

Figure 17:
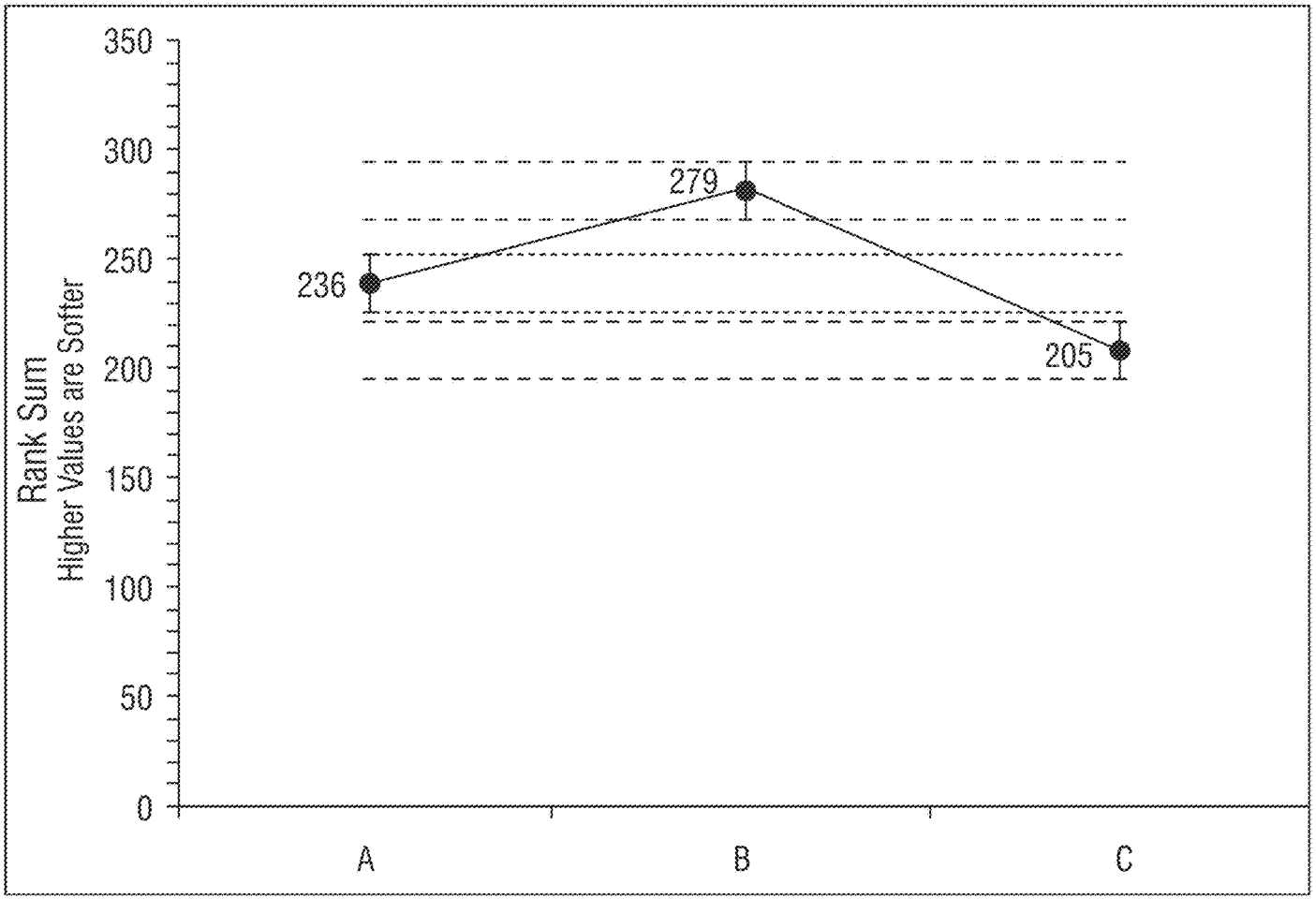

As shown in FIG. 17, the softening using Clearly Soft and Sisterna sucrose esters added together at 10% actives was outperformed by the sequential addition of the softening booster after the dosing of Clearly Soft.

TABLE 21

| Sample | Product | Grams | Booster | Grams of Booster | Actives to Softener Ratio (%) |
|---|---|---|---|---|---|
| A | L2000/Bleach/ Clearly Soft | 90/70/52 | None | 0 | 0 |
| B | L2000/Bleach/ Clearly Soft | 90/70/52 | Gelwhite GP clay (10% soln) added at 20% actives | 104 | 20 |
| C | L2000/Bleach/ Clearly Soft | 90/70/52 | Sisterna PS750-C (10% soln) added at 20% actives | 104 | 20 |
| D | L2000/Bleach/ Clearly Soft | 90/70/52 | Arquad 2HT-75 (10% soln) added at 20% actives | 104 | 20 |

Figure 18:
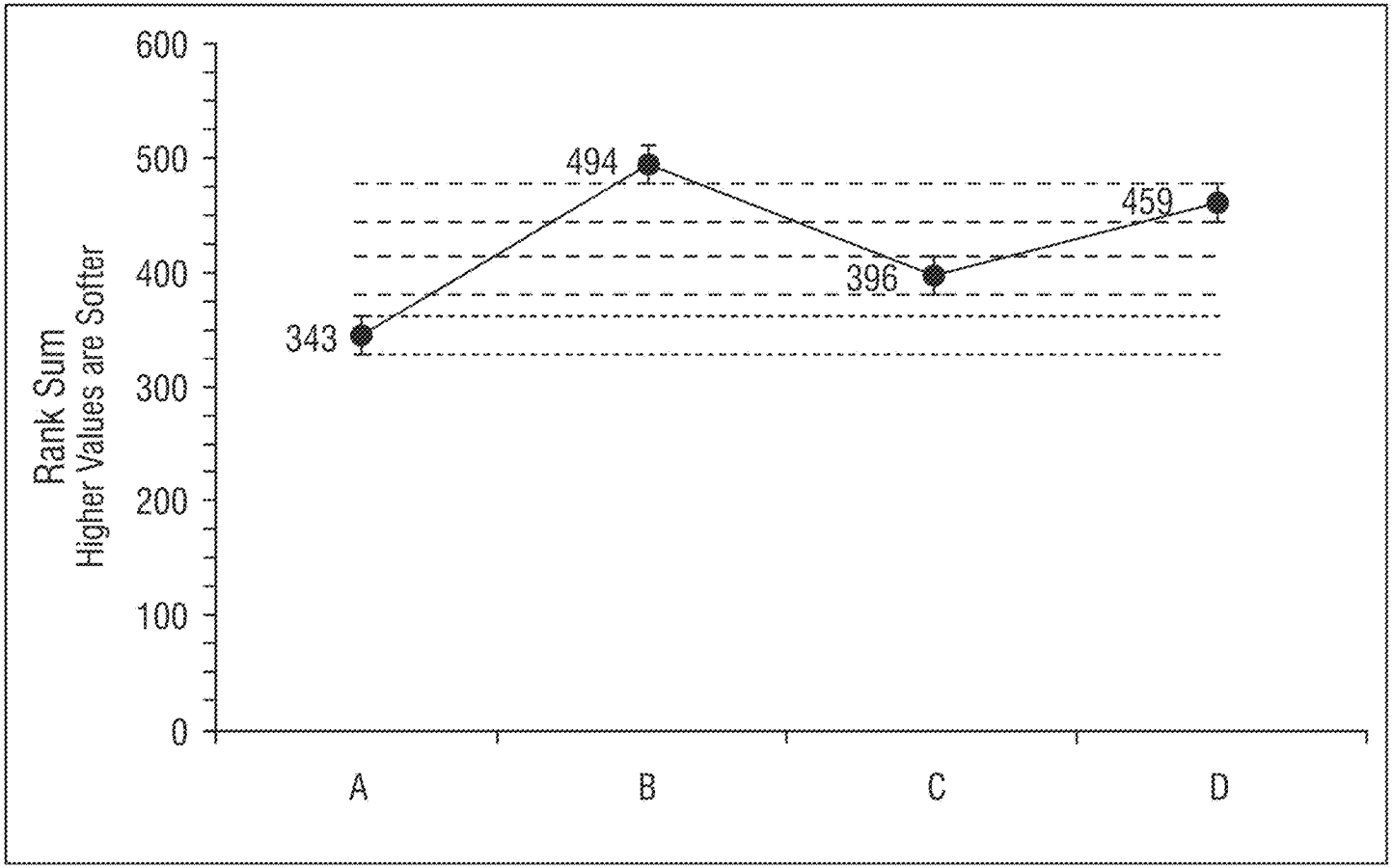

As shown in FIG. 18, the softening using Gelwhite OP clay outperformed the comparative softening boosters in head-to-head trial at 20% actives. Arquad 2HT-75 was the second preferred softening booster in the trial.

TABLE 22

| Sample | Product | Grams | Booster | Grams of Booster | Actives to Softener Ratio (%) |
|---|---|---|---|---|---|
| A | L2000/Bleach/ Clearly Soft | 90/70/52 | None | 0 | 0 |
| B | L2000/Bleach/ Clearly Soft | 90/70/52 | Sisterna PS750-C (10% soln) added at 10% actives sucrose palmitate | 52 | 10 |
| C | L2000/Bleach/ Clearly Soft | 90/70/52 | Gelwhite GP clay (10% soln) added at 20% actives | 104 | 20 |
| D | L2000/Bleach/ Clearly Soft | 90/70/52 | 2X Clearly Soft | 104 | 20 |

Figure 19:
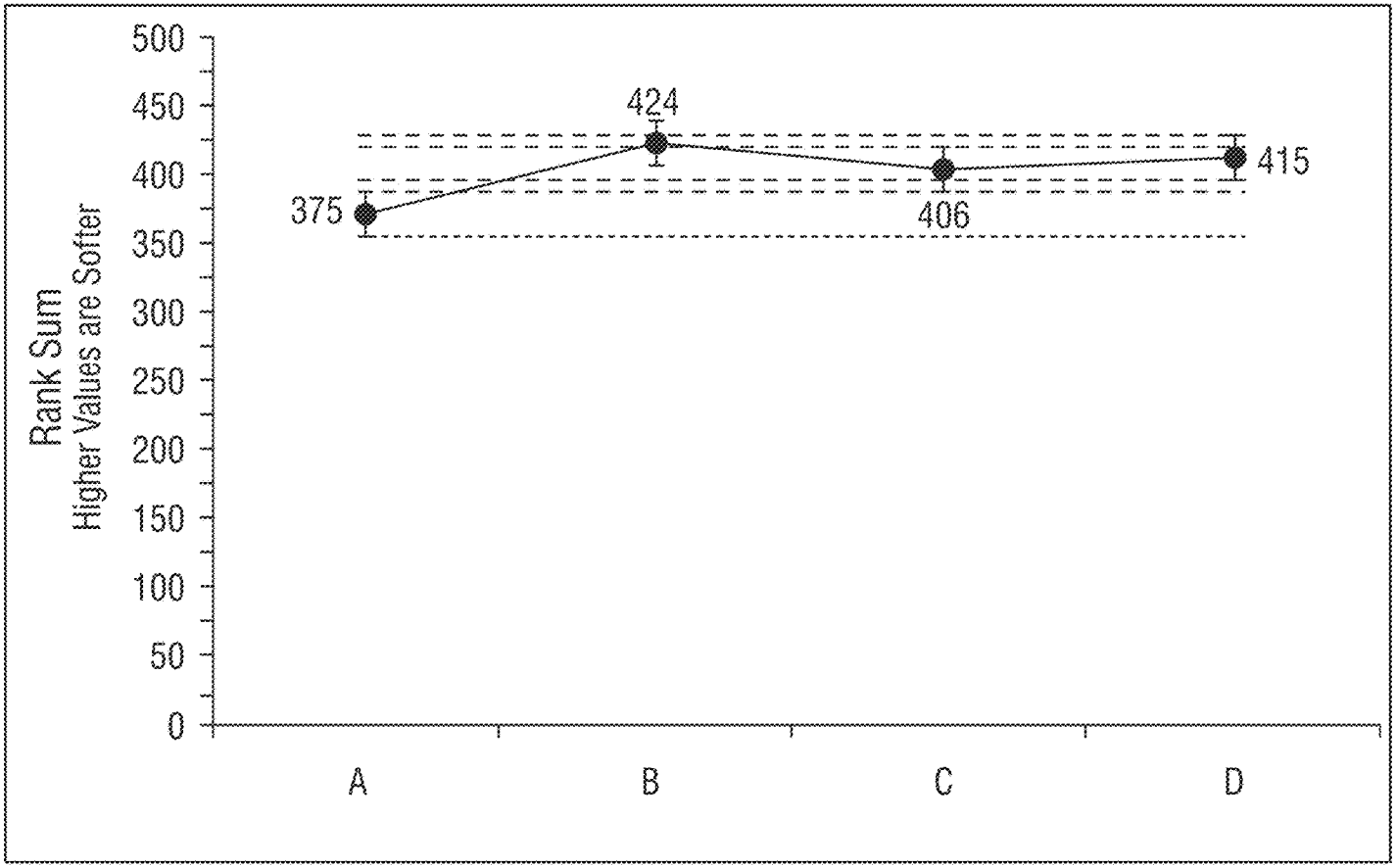

As shown in FIG. 19, there was no clear winner in the softening over the 2x Clearly Soft load. Sisterna was added in the second half of the softening cycle and Gelwhite was added in the first half of the softening cycle.

TABLE 23

| Sample | Product | Grams | Booster | Grams of Booster | Actives to Softener Ratio (%) |
|---|---|---|---|---|---|
| A | L2000/Bleach/ Clearly Soft | 90/70/52 | None | 0 | 0 |
| B | L2000/Bleach/ Clearly Soft | 90/70/52 | Gelwhite GP clay (10% soln) | 52 | 10 |
| C | L2000/Bleach/ Clearly Soft | 90/70/52 | Gelwhite GP clay (10% soln) added in $6^{th}$ cycle without drying | 104 | 20 |
| D | L2000/Bleach/ Clearly Soft | 90/70/52 | Gelwhite GP clay (10% soln) added in $6^{th}$ cycle with drying | 104 | 20 |

Figure 20:
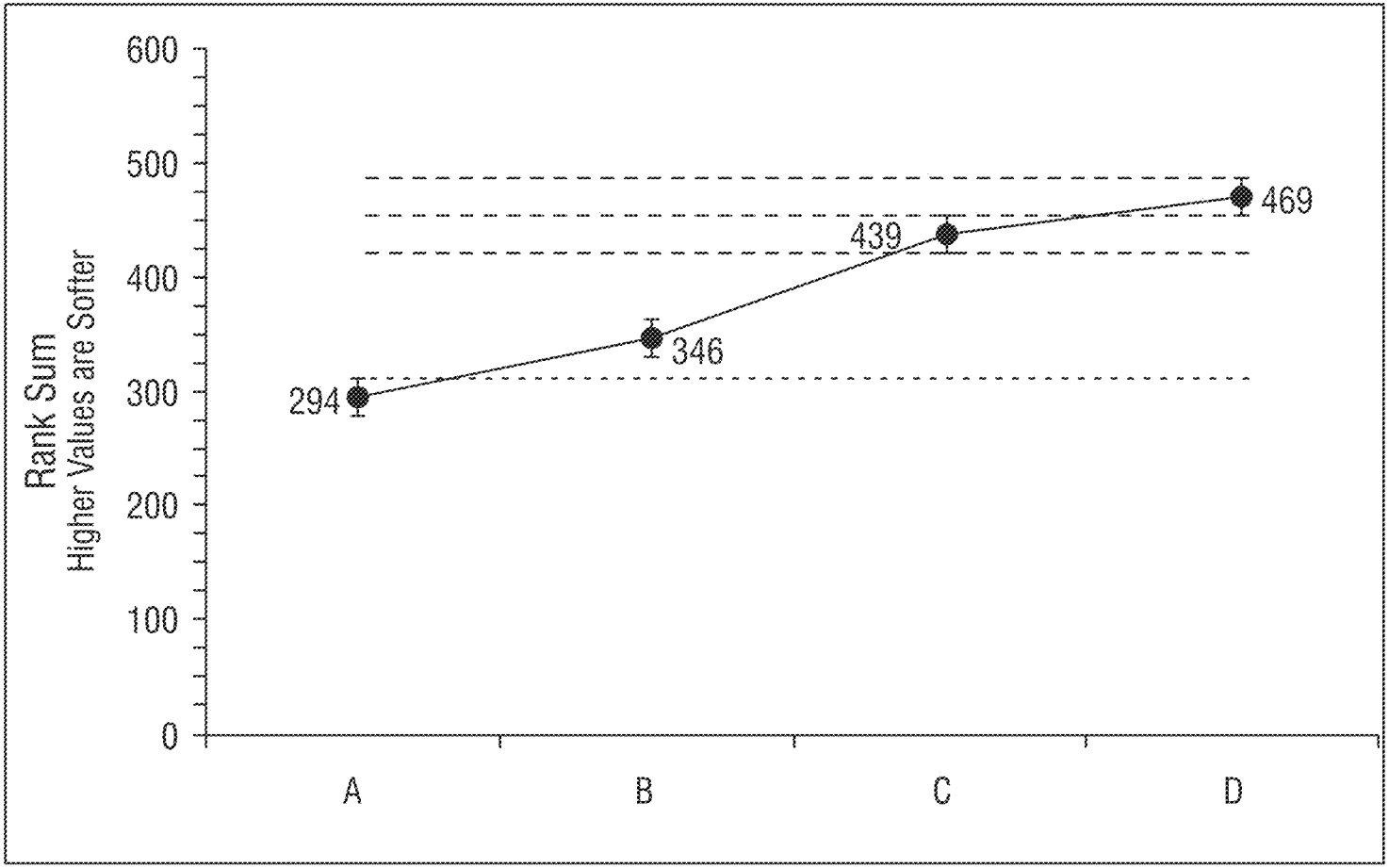

As shown in FIG. 20, the winner in the softening evaluation was use of the Gelwhite OP clay with drying when added in the $6^{th}$ cycle.

TABLE 24

| Sample | Product | Grams | Booster | Grams of Booster | Actives to Softener Ratio (%) |
|---|---|---|---|---|---|
| A | L2000/Bleach/ Clearly Soft | 90/70/52 | Gelwhite GP clay (10% soln) and Clearly Soft in $6^{th}$ cycle | 104 | 20 |
| B | L2000/Bleach/ Clearly Soft | 90/70/52 | Gelwhite GP clay (10% soln) only in $6^{th}$ cycle | 104 | 20 |
| C | L2000/Bleach/ Clearly Soft | 90/70/52 | Clearly Soft only in $6^{th}$ cycle | 0 | 0 |

Figure 21:
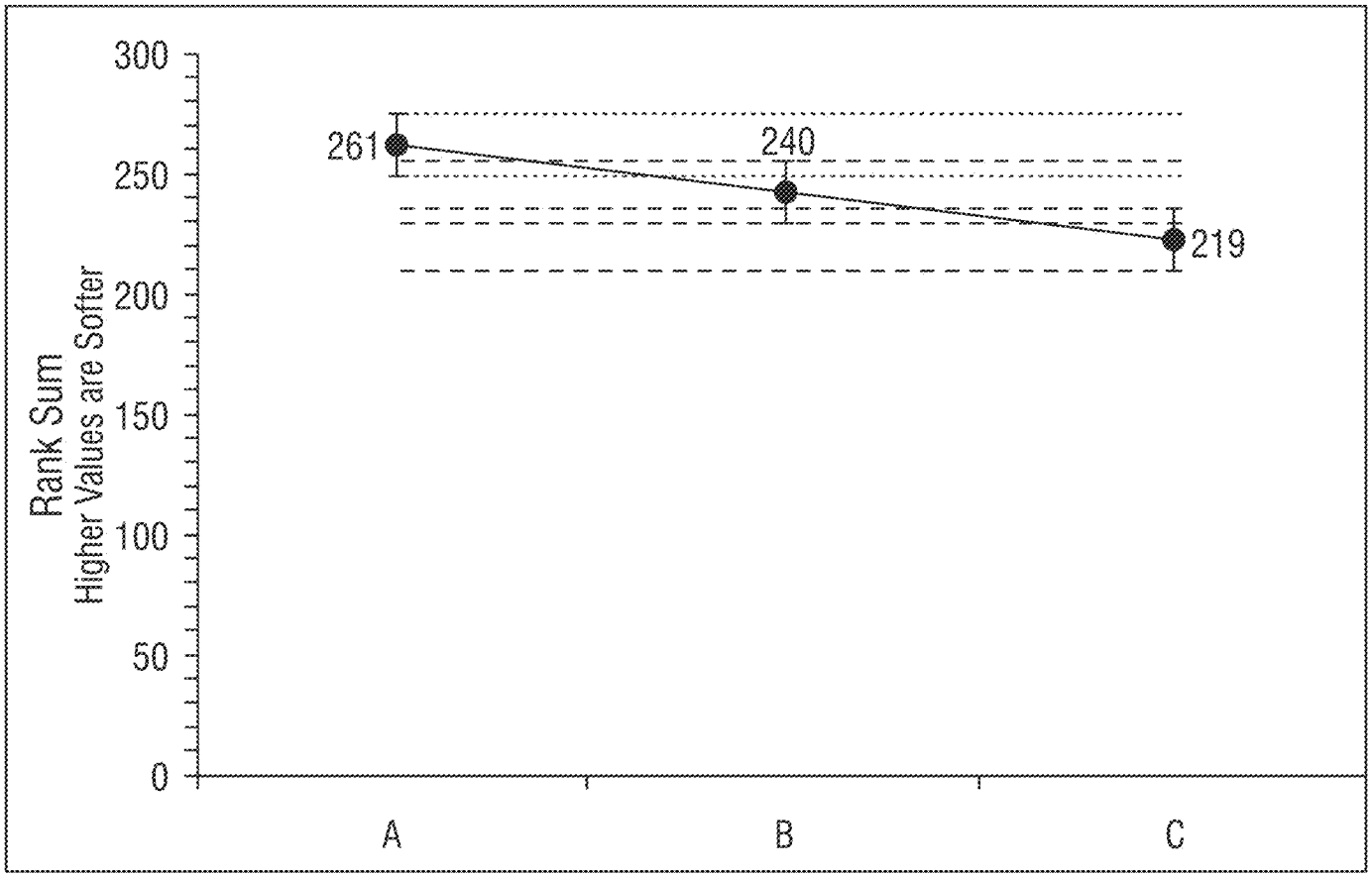

As shown in FIG. 21, the winner in the softening evaluation was the combined use of Clearly Soft and Gelwhite GP clay with drying when added in the $6^{th}$ cycle.

Example 2

To confirm the softening boosters do not negatively impact linens, yellowing testing was conducted using Gelwhite in the first half of the Booster cycle. to measure any yellowing effects of the boosted softening systems. The test conditions of Table 43 were employed.

The HunterLab Color Quest Spectrophotometer was conducted after the $6^{th}$ cycle employing the softening booster compositions according to the invention were added Reading Towels on the Hunterlab. The purpose is to measure reflectance of towels. The HunterLab Colorquest XE spectrophotometer is employed. As shown in Table 25, the data generated appear as L*, a*, b*, WI 313, YI 313, and Z %.

L*—The light to dark number in the color solid. 0=totally black, 100=totally white. This is the number used for Percent Soil Removal calculations.

a*—The red to green number in the color solid. A positive number is toward red and a negative number is toward green.

b*—The yellow to blue number in the color solid. A positive number is toward yellow and a negative number is toward blue.

WI 313—Whiteness Index. This an index of overall whiteness that also takes the "b" number into account. The higher the number, the whiter the sample.

YI 313—Yellowness Index. This an index of overall yellowness that also takes the "b" number into account. The higher the number, the yellower the sample. Z %

TABLE 25

| ID | L* | a* | b* | WI E313 | YI E313 | Z % | Average b* |
|---|---|---|---|---|---|---|---|
| B8 | 95.99 | −0.36 | 0.3 | 88.61 | 0.24 | 89.56 | 0.15 |
| B7 | 95.72 | −0.36 | 0.25 | 88.2 | 0.13 | 88.98 | |
| B6 | 95.75 | −0.29 | 0.11 | 88.93 | −0.09 | 89.26 | |
| B5 | 95.83 | −0.36 | 0.06 | 89.3 | −0.22 | 89.51 | |
| B4 | 95.83 | −0.36 | 0.07 | 89.3 | −0.22 | 89.52 | |
| B3 | 96.04 | −0.32 | 0.01 | 90.03 | −0.3 | 90.08 | |
| B2 | 96.03 | −0.27 | −0.04 | 90.24 | −0.35 | 90.13 | |
| B1 | 95.51 | −0.41 | 0.44 | 86.83 | 0.46 | 88.22 | |
| A8 | 95.72 | −0.26 | 0.05 | 89.11 | −0.18 | 89.27 | 0.1075 |
| A7 | 95.92 | −0.23 | 0.14 | 89.2 | 0.02 | 89.63 | |
| A6 | 96.09 | −0.27 | 0.17 | 89.44 | 0.05 | 89.98 | |
| A5 | 96.13 | −0.27 | 0.11 | 89.81 | −0.07 | 90.16 | |
| A4 | 95.69 | −0.34 | 0.28 | 87.99 | 0.21 | 88.88 | |
| A3 | 95.99 | −0.27 | 0.02 | 89.88 | −0.23 | 89.96 | |
| A2 | 96.12 | −0.23 | −0.13 | 90.9 | −0.5 | 90.49 | |
| A1 | 96.24 | −0.28 | 0.22 | 89.6 | 0.13 | 90.29 | |
| C8 | 96.18 | −0.26 | −0.02 | 90.54 | −0.31 | 90.48 | 0.17875 |
| C7 | 96.09 | −0.32 | 0.26 | 89.03 | 0.18 | 89.85 | |
| C6 | 95.64 | −0.37 | 0.24 | 88.05 | 0.11 | 88.81 | |
| C5 | 95.85 | −0.32 | 0.17 | 88.87 | 0.02 | 89.41 | |
| C4 | 95.9 | −0.33 | 0.04 | 89.59 | −0.25 | 89.71 | |
| C3 | 95.55 | −0.41 | 0.41 | 87.07 | 0.4 | 88.36 | |
| C2 | 95.89 | −0.27 | −0.08 | 90.12 | −0.43 | 89.87 | |
| C1 | 95.79 | −0.39 | 0.41 | 87.66 | 0.41 | 88.94 | |

As shown in Table 25 there was no significant difference in yellowing caused by the tested boosting softeners. Accordingly, the softening boosters provide desired softness without imparting any detrimental yellowing of the treated linens.

Example 3

Wicking testing was conducted to assess absorption of water from evaluated towels treated with softening boosters. The absorbency of towels from the softness panel in Example 2 were evaluated to determine how different fabric treatments affect the wicking/absorption volume of a fabric.

Three test swatches (approximately 4"×7") are cut. The swatches are marked with a line 10 mm from the bottom and placed in the colored dye solution (water soluble dye of any concentration) using a wicking apparatus. One test swatch is suspended from the top of the wicking apparatus using a large paper binder clamp. The test swatch is lowered into the colored dye solution up to the scored line and let to sit undisturbed for 6 minutes. Thereafter, the test swatch is raised from the dye solution and the highest point reached by the dye solution is marked by a dot (using a permanent marker). The distance from the 10 mm line to the dot (in millimeters) is measured and recorded. The procedure is repeated for all swatches and an average of 3 measurements is used for the final data point.

TABLE 26

| Condition | Product | Grams | Booster | Grams of Booster | Avg. Distance (mm) |
|---|---|---|---|---|---|
| A | L2000/Bleach/Clearly Soft | 90/70/52 | Clearly Soft & Gelwhite added together in $6^{th}$ cycle | 104 | 41.6 |
| B | L2000/Bleach/Clearly Soft | 90/70/52 | Gelwhite only in $6^{th}$ cycle | 104 | 68.3 |
| C | L2000/Bleach/Clearly Soft | 90/70/52 | Clearly Soft only in $6^{th}$ cycle | 0 | 50 |

Figure 22:
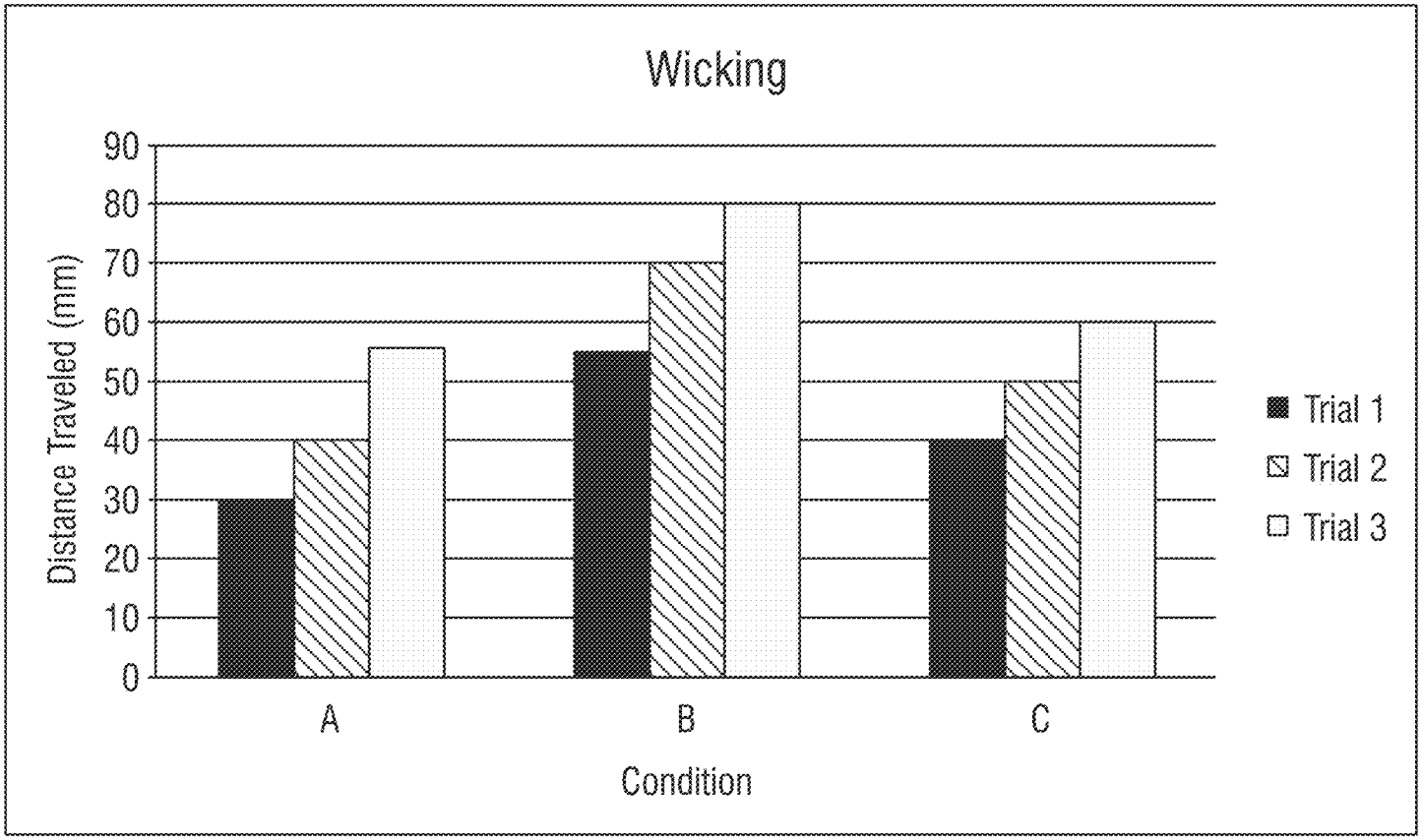
FIG. 22 is a graph evaluating wicking (rating of water absorbency) resulting from evaluated softening boosters according to embodiments of the invention.

20 mm or more is considered acceptable wicking. The results of the distance traveled (mm) is shown above in Table 26 (average) and in FIG. 22 (depicted Trials 1-3), wherein the combination of the Gelwhite and Clearly Soft in $6^{th}$ cycle demonstrated most significant wicking (absorbed the least amount of water). However, all softening booster conditions outperformed the commercially-acceptable standard of greater than 20 mm. In addition, the Gelwhite softening booster alone absorbed more water than Clearly Soft alone.

Example 4

Additional wicking testing was conducted after the evaluation of Example 3 using the conditions set forth in Table 27. The Conditions C and D each refer, respectively, to the booster added in an additional $6^{th}$ cycle where they towels were either not dried or dried prior to the $6^{th}$ cycle. All towels were dried after completing the cycles in the washer to build up the appropriate amount of chemistry (with or without softening booster).

TABLE 27

| Condition | Product | Grams | Booster |
|---|---|---|---|
| A | L2000/Bleach/Clearly Soft | 90/70/52 | None |
| B | L2000/Bleach/Clearly Soft | 90/70/52 | Gelwhite added in $5^{th}$ cycle |
| C | L2000/Bleach/Clearly Soft | 90/70/52 | Gelwhite added in $6^{th}$ cycle-no drying |
| D | L2000/Bleach/Clearly Soft | 90/70/52 | Gelwhite added in $6^{th}$ cycle-with drying |

Figure 23:
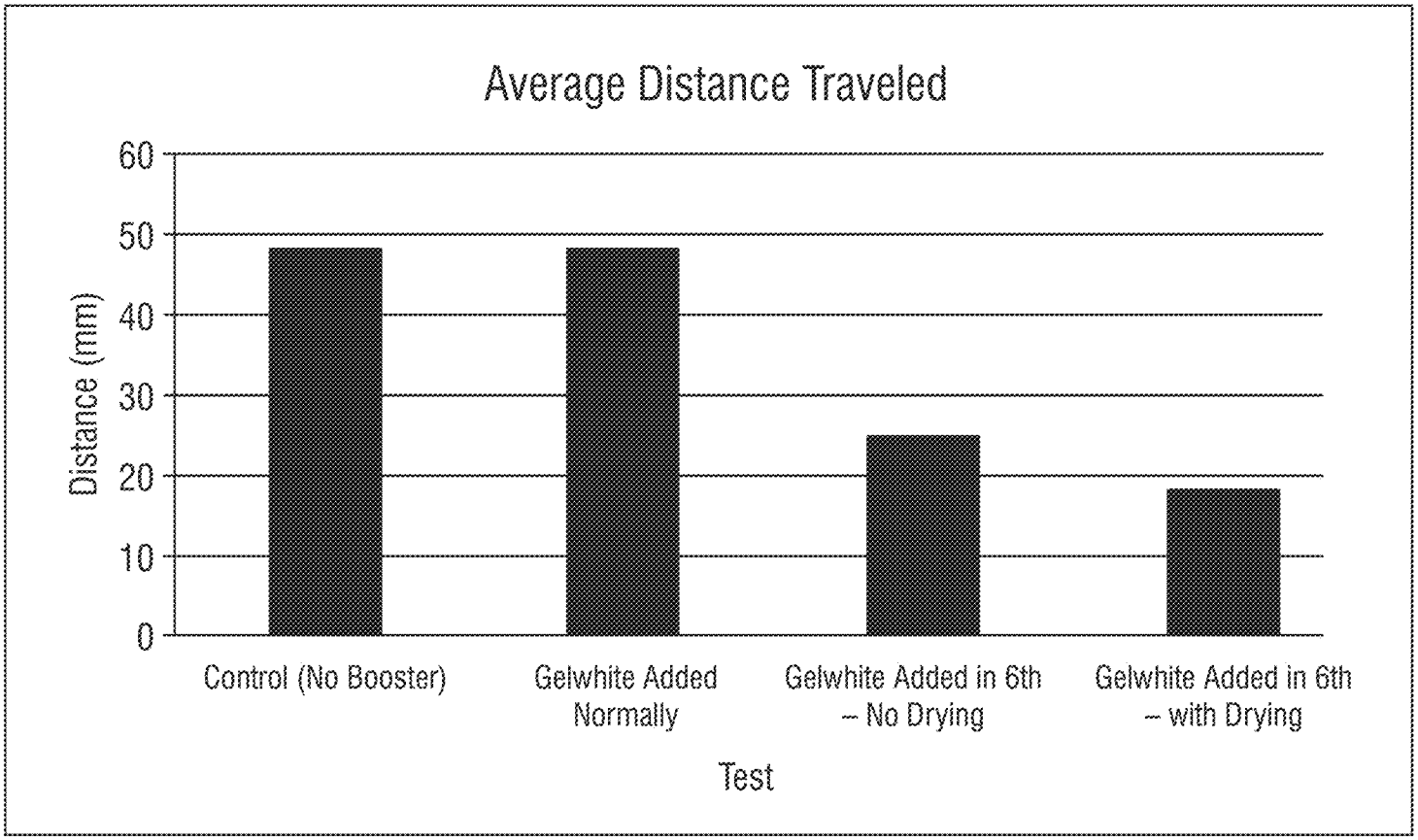
FIG. 23 is a graph evaluating distance of dye travel (another wicking rating of water absorbency) resulting from softening boosters according to embodiments of the invention wherein timing of boosters were evaluated.

As shown in FIG. 23, the test conditions where the liquid traveled farthest were the control an Gelwhite OP added during the $5^{th}$ cycle. The two conditions where an additional $6^{th}$ cycle was added to provide Clearly Soft and Gelwhite OP demonstrated considerably lower wicking ability. Notably, only the condition D with a drying step before the $6^{th}$ cycle provided wicking below the threshold level of 20 mm (conventional wicking standard).

Example 5

Additional testing of the effectiveness of the softening booster to soften towels in a single booster cycle at varying concentrations was conducted. Towels were treated with the applicable booster in combination with only Clearly Soft (in the booster cycle). The booster was added first and allowed to wash for 3 minutes before adding the Clearly Soft. The towels were then rinsed, drained and spun down before drying.

TABLE 28

| Sample | Booster | Grams of Booster | Grams of Clearly Soft |
|---|---|---|---|
| A | Gelwhite GP + 1% Fragrance | 104 (1×) | 52 (1×) |
| B | Gelwhite GP + 1% Fragrance | 208 (2×) | 52 (1×) |
| C | Gelwhite GP + 1% Fragrance | 104 (1×) | 104 (2×) |
| D | Gelwhite GP + 1% Fragrance | 208 (2×) | 104 (2×) |

The softness evaluation was conducted as shown in Table 29. A softness panel (varying number of participates with average score) completed one-on-one sensory comparisons of evaluated towels treated with the fabric treatment composition according to the invention. The towel with the preferred softness based on the touch (sensory) evaluation of the panelist was ranked numerically based on a standard towel as a comparison (tanked 1 to 5). A high panel testing number correlates to softer panel evaluation results.

TABLE 29

| Order | D 1 | A 2 | B 3 | C 4 | A 5 | B 6 | D 7 | C 8 |
|---|---|---|---|---|---|---|---|---|
| | | | Panelist | | | | | |
| 1 | 1 | 1 | 3 | 2 | 2 | 2 | 2 | 2 |
| 2 | 1 | 0 | 1 | 3 | 2 | 0 | 1 | 2 |
| 3 | 1 | 1 | 3 | 3 | 3 | 2 | 1 | 3 |
| 4 | 1 | 0 | 1 | 3 | 3 | 0 | 2 | 1 |
| 5 | 1 | 1 | 2 | 4 | 2 | 1 | 2 | 2 |
| 6 | 1 | 1 | 2 | 3 | 2 | 1 | 2 | 1 |
| 7 | 2 | 1 | 3 | 3 | 2 | 2 | 1 | 3 |
| 8 | 1 | 1 | 1 | 3 | 1 | 0 | 0 | 2 |
| 9 | 0 | 1 | 3 | 2 | 2 | 2 | 2 | 4 |
| 10 | 1 | 1.5 | 2.5 | 3 | 2.5 | 2 | 2 | 2.5 |
| 11 | 2 | 1 | 4 | 4 | 1 | 1 | 1 | 2 |
| 12 | 2 | 2 | 3 | 4 | 3 | 2 | 2 | 3 |
| 13 | 2 | 1 | 2 | 3 | 3 | 3 | 2 | 4 |
| 14 | 1 | 1 | 2 | 2 | 3 | 2 | 2 | 3 |
| 15 | 1 | 1 | 2 | 2 | 1 | 2 | 1 | 2 |
| 16 | 2 | 1 | 3 | 5 | 3 | 2 | 1 | 5 |
| 17 | 1 | 1 | 2 | 2 | 1 | 1 | 1 | 2 |
| 18 | 1 | 1 | 3 | 3 | 4 | 2 | 3 | 3 |

TABLE 29-continued

| | | | | | | | | |
|---|---|---|---|---|---|---|---|---|
| 19 | 1 | 1 | 3 | 3 | 2 | 2 | 3 | 2 |
| 20 | 1 | 1 | 2 | 3 | 2 | 2 | 2 | 2 |
| 21 | 1 | 1 | 2 | 2 | 3 | 1 | 1 | 2 |
| Sums | 25 | 20.5 | 49.5 | 62 | 47.5 | 32 | 34 | 52.5 |
| Per Towel Avg | 1.1 | 0.97 | 2.3 | 2.9 | 2.3 | 1.5 | 1.6 | 2.5 |

| | A | B | C | D |
|---|---|---|---|---|
| Total Sum | 59 | 81.5 | 114.5 | 59 |
| Avg | 1.4 | 1.9 | 2.7 | 1.4 |

The panel results show that the 2x/2x combination was equally soft as the 1x/1x combination. The highest softness rating was achieved for the 1x/2x combination (1x softening booster composition/2x fabric softening composition) A limitation of the testing was the lack of consistency among the fill towels (not equal in treatment or age which may have introduced variability into the test results).

Example 6

Additional panel testing was conducted to assess towel softness. Towels were washed for a full cycle of detergent, bleach and Clearly Soft. The booster was then hand dosed and washed for 3 minutes. Additional Clearly Soft was then hand dosed and washed for 3 minutes. The towels were then rinsed, drained and spun down before drying.

TABLE 30

| Sample | Product | Booster | Grams of Booster | Grams of Clearly Soft |
|---|---|---|---|---|
| A | L2000/Bleach/ Clearly Soft | Control | 0 | 0 |
| B | L2000/Bleach/ Clearly Soft | Gelwhite GP + 1% Fragrance + Clearly Soft | 200 | 100 |

Figure 24:
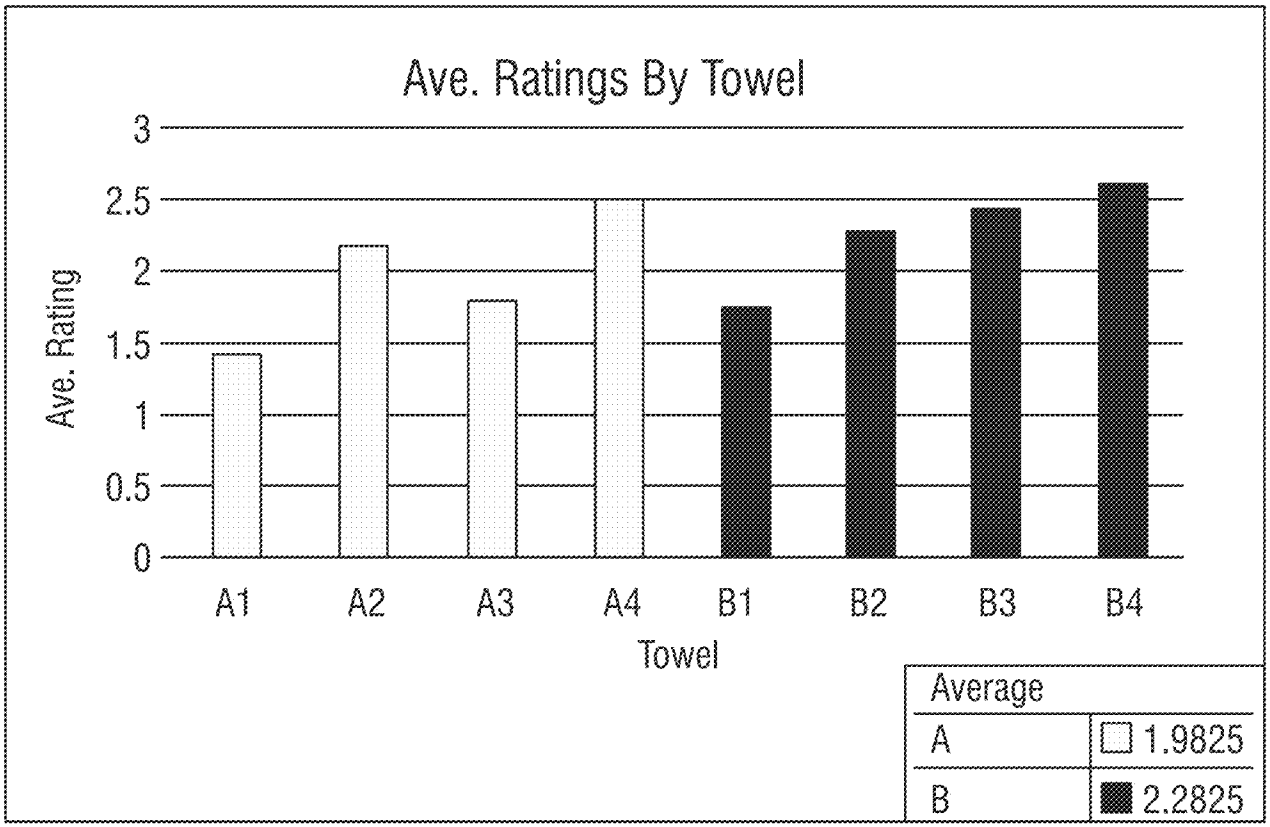
FIG. 24 is a graph showing the average softness rating by towel evaluating softening boosters according to embodiments of the invention.

As shown in FIG. 24 there was a slight difference in rating between the sets of towels, with improved softness rating for the boosted formulations.

Example 7

Additional softness ratings were conducted. A 2x/2x Gelwhite GP and Clearly Soft system were prepared for an 85 lb washer.

TABLE 31

| Sample | Product | Grams | Booster | Grams of Booster (2×) | Grams of Clearly Soft (2×) |
|---|---|---|---|---|---|
| A | Washed in Field | N/A | None | 0 | 0 |
| B | Washed in Field | N/A | Gelwhite GP (10%) | 582 | 300 |

Figure 25:
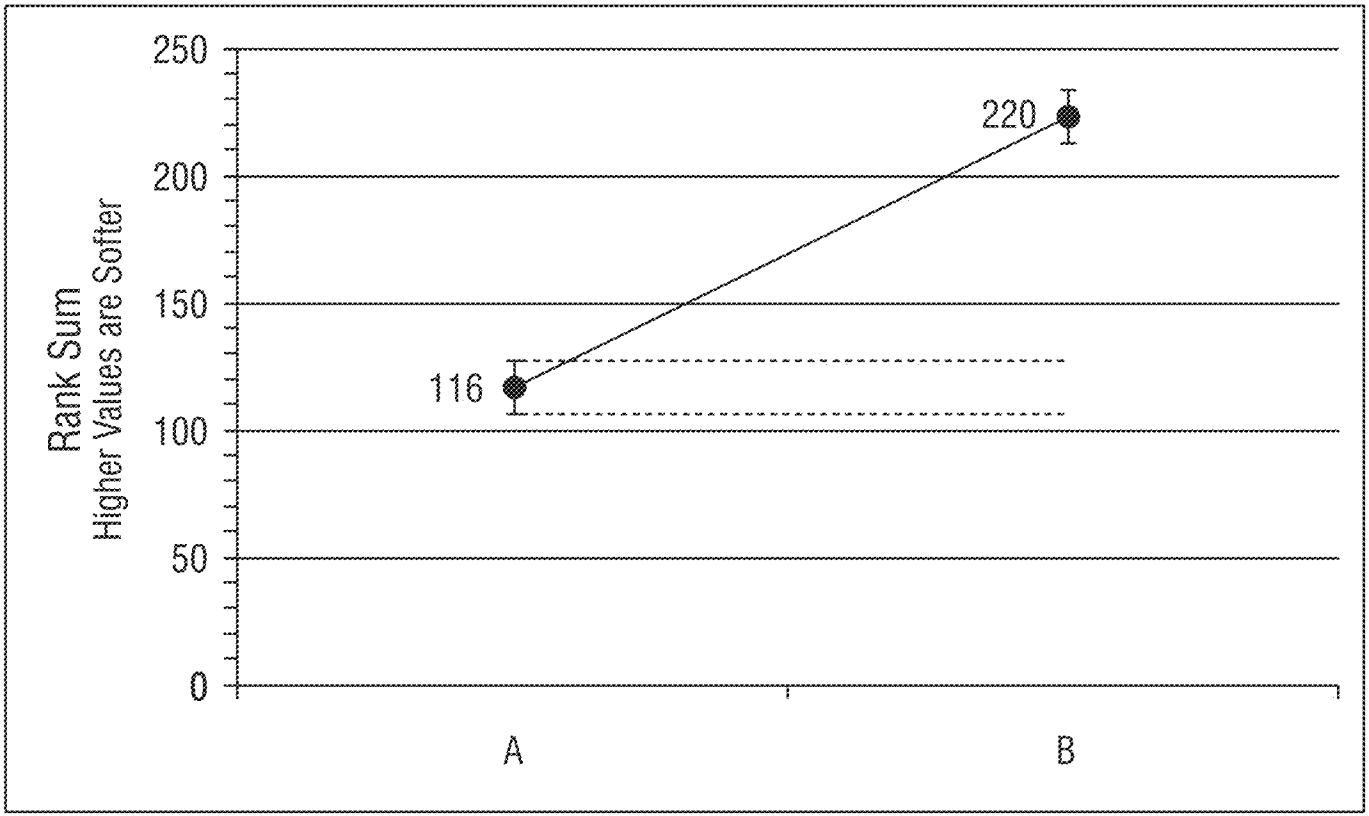
FIG. 25 shows a graph with rank sum ratings for softening boosters evaluated according to embodiments of the invention (high values correlate to softer panel evaluation results).

As shown in FIG. 25, the boosting agent provided significant improvement in softening.

Example 8

Additional testing of the effectiveness of the softening booster to soften the towels was conducted. The booster was added directly onto towels through the washer door instead of being dispensed through a flush cup. 8 hand towels from a hotel were used for the softness test (4 towels were used for each two conditions listed in Table 32). A 35 lb machine was filled to 80% capacity with additional towels that were scoured and rinsed thoroughly beforehand. Towels were washed in 1 booster cycle with the following conditions;

A—Washed at account; no additional treatment.

B—Gelwhite GP and Clearly soft were mixed together and added directly onto the towels before the program was started. Towels were then washed for 6 minutes.

C—Gelwhite GP was added directly onto the towels before the program was started and Clearly soft was dosed through the top of the machine after 3 minutes of wash time.

TABLE 32

| Sample | Product | Grams | Booster* | Grams of Booster | Grams of CS |
|---|---|---|---|---|---|
| A | Washed in Field | N/A | Control | | |
| B | Washed in Field | N/A | Gelwhite and Clearly Soft mixed, added on top of towels | 208 (Of 10% solution) | 104 |
| C | Washed in Field | N/A | Gelwhite Added on top of towels, Clearly Soft dosed | 209 (Of 10% solution) | 104 |

Figure 26:
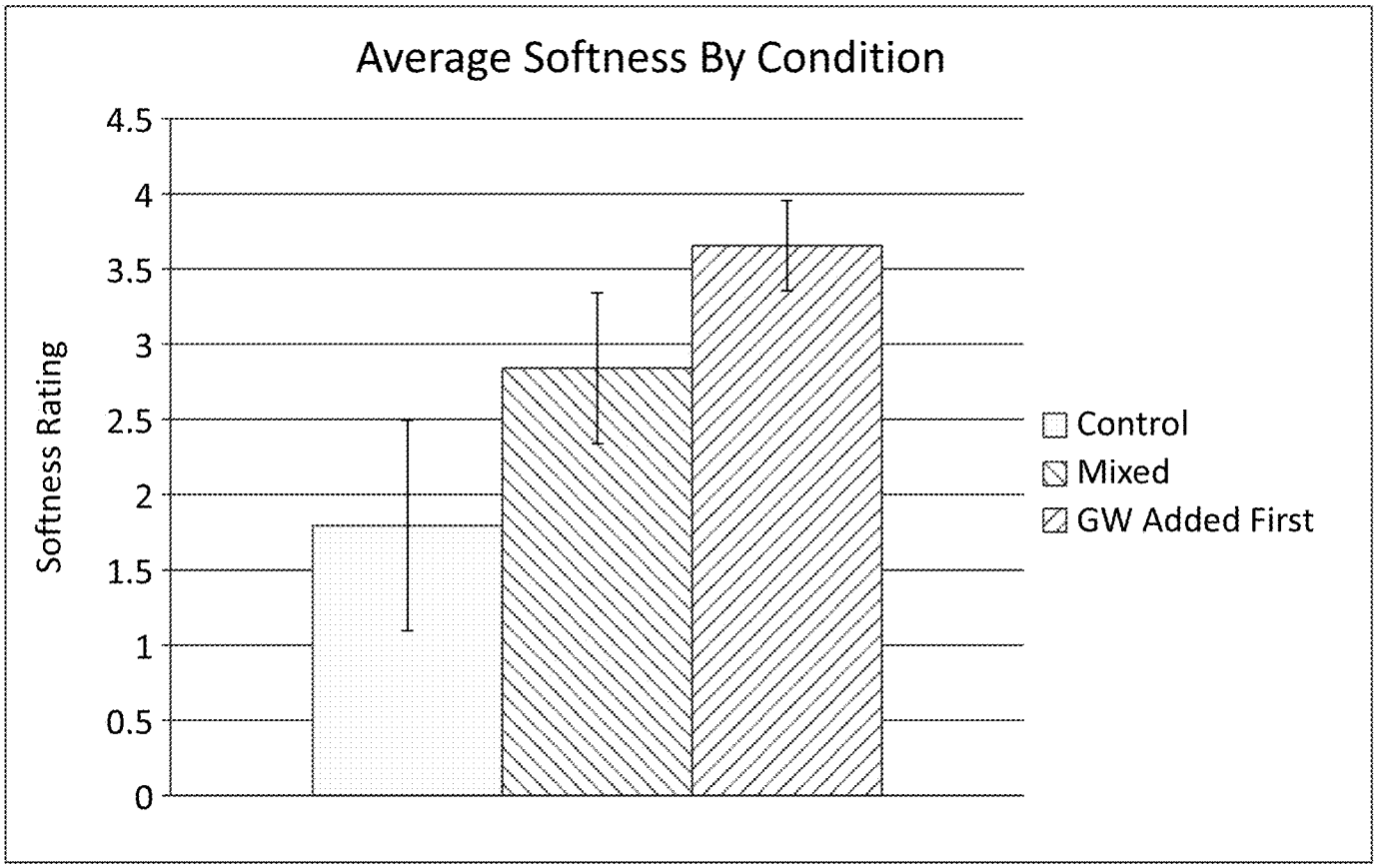
FIG. 26 shows a graph measuring average softness ratings by various conditions of adding softening boosters according to embodiments of the invention.
Figure 27:
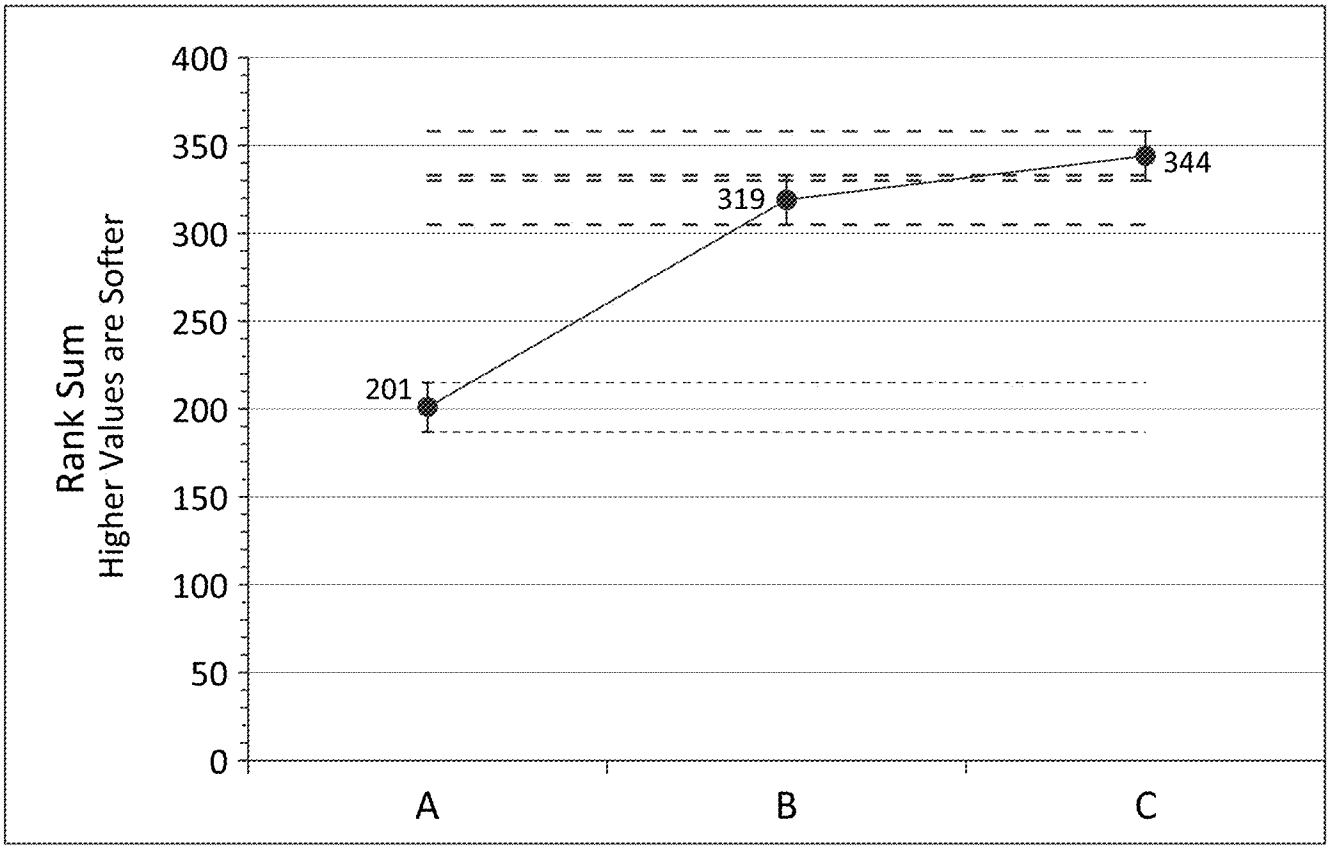
FIG. 27 shows a graph with rank sum ratings for softening boosters evaluated according to embodiments of the invention (high values correlate to softer panel evaluation results).

The results are shown in FIGS. 26-27, wherein the greatest softness rating was achieved by the Gelwhite softening booster added to the towels before the Clearly Soft softening agent (condition C). Condition B also performed significantly better than the control (absence of the softening booster).

The inventions being thus described, it will be obvious that the same may be varied in many ways. Such variations are not to be regarded as a departure from the spirit and scope of the inventions and all such modifications are intended to be included within the scope of the following claims.

The above specification provides a description of the manufacture and use of the disclosed compositions and methods. Since many embodiments can be made without departing from the spirit and scope of the invention, the invention resides in the claims.

What is claimed is:

1. A method of conditioning and softening fabrics, comprising:

(a) washing the fabrics in a detergent with a pH range of about 7 to about 14;

(b) contacting the fabrics with a fabric softening composition comprising from about 10 wt-% to about 55 wt-% of a quaternary amidoamine softening agent;

(c) contacting the fabrics with a softening booster composition comprising a sucrose fatty acid ester; and (d) drying the fabrics;

wherein the fabric softening composition and softening booster composition are dosed separately.

2. The method of claim 1, wherein the softening booster composition has a %-actives concentration in use of from about 0.1% to about 40%.

3. The method of claim 1, wherein the softening booster composition is selected from the group consisting of sucrose laurate, sucrose palmitate, sucrose stearate, sucrose distearate, sucrose polystearate, sucrose tetrastearate triacetate, and combinations of the same.

4. The method of claim 1, further comprising a quaternary ammonium surfactant in the fabric softening composition.

5. The method of claim 1, wherein the fabric softening composition comprises a quaternary ammonium compound in the amount of about 10 wt-% to about 45 wt %.

6. The method of claim 1, wherein the fabric softening composition further comprises a solidification agent and/or a surfactant.

7. The method of claim 6, wherein the percent actives ratio of fabric softening composition to softening booster composition is between about 2:1 to about 1:2.

8. The method of claim 1, wherein the fabric softening composition has a use solution pH in the range of about 2 to about 8 and the softening booster composition has a use solution pH in the range of about 2 to about 10.

9. A method of softening fabrics, comprising:

(a) contacting the fabrics with a liquid or solid fabric softening composition comprising from about 10 wt-% to about 55 wt-% of a quaternary amidoamine softening agent and a softening booster composition comprising a sucrose fatty acid ester in a rinse cycle; and (b) drying the fabrics;

wherein the softening booster composition comprises in a use solution on an actives % basis from about 0.1% to about 40% sucrose fatty acid ester and wherein the fabric softening composition and softening booster composition are dosed separately.

10. The method of claim 9, wherein the softening booster composition is added in sequential dosing either before or after the fabric softening composition in said rinse cycle.

11. The method of claim 9, wherein the softening agent of the fabric softening composition is about 10 wt-% to about 45 wt-% quaternary ammonium component.

12. The method of claim 11, wherein the percent actives ratio of fabric softening composition to softening booster composition is between about 2:1 to about 1:2.

13. A conditioning and softening fabric system comprising:

a first fabric conditioning composition comprising an amino-functionalized silicone softening agent and a softening agent which is a quaternary amidoamine; and a second softening booster composition comprising in a use solution on an actives % basis from about 0.1% to about 40% of a sucrose fatty acid ester softening booster.

14. The system of claim 13, wherein the softening booster composition is selected from the group consisting of sucrose laurate, sucrose palmitate, sucrose stearate, sucrose disterarate, sucrose polystearate, sucrose tetrastearate triacetate, and combinations of the same.

15. The system of claim 14, wherein the softening booster composition is sucrose laurate, sucrose palmitate and/or sucrose stearate.

16. The system of claim 13, wherein the fabric conditioning composition further comprises a quaternary ammonium surfactant.

17. The system of claim 13, wherein the first composition and/or the second composition are liquids, powders and/or solids.

18. The system of claim 13, wherein the first and/or second composition further comprises at least one additional functional ingredient selected from the group consisting of fragrances and/or dyes, anti-static agents, fiber protection agents, anti-wrinkling agents, soil release agents, optical brighteners, UV protection agents, anti-pilling agents, water repellency agents, disinfecting and/or sanitizing agents, scouring agents, insect repellants, bleaching agents, solubility modifiers, rheology modifiers or thickeners, buffers, solvents, dye scavengers, molecular chelants, sequestering agents and combinations of the same.

* * * * *